US006175715B1

(12) United States Patent
Hirao et al.

(10) Patent No.: US 6,175,715 B1
(45) **Date of Patent: *Jan. 16, 2001**

(54) DOUBLE-SIDED PRINTING APPARATUS

(75) Inventors: Naoto Hirao; Kenji Fuke; Masaaki Ohyama; Katsuya Shimatsu, all of Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/340,597

(22) Filed: Jun. 28, 1999

(30) Foreign Application Priority Data

Oct. 27, 1998 (JP) ..... 10-306059

(51) Int. Cl.[7] ..... G03G 15/00; G03G 21/00
(52) U.S. Cl. ..... 399/384; 399/400
(58) Field of Search ..... 399/384, 401, 399/400, 397

(56) References Cited

U.S. PATENT DOCUMENTS

| | | | | |
|---|---|---|---|---|
| 4,609,279 | | 9/1986 | Hausmann et al. . | |
| 4,668,073 | * | 5/1987 | Hatabe et al. | 399/336 |
| 5,258,809 | * | 11/1993 | Weidemer | 399/112 |
| 5,455,668 | | 10/1995 | De Bock et al. . | |
| 5,461,470 | | 10/1995 | De Cock . | |
| 5,548,390 | | 8/1996 | Sugisaki et al. . | |
| 5,623,719 | | 4/1997 | De Cock et al. . | |
| 5,671,475 | | 9/1997 | De Cock et al. . | |
| 5,835,836 | * | 11/1998 | Hirao | 399/336 |
| 5,842,093 | * | 11/1998 | Tanda | 399/263 |

FOREIGN PATENT DOCUMENTS

| | | |
|---|---|---|
| 56-88161 | 7/1981 | (JP) . |
| 58-173774 | 10/1983 | (JP) . |
| 60-201954 | 10/1985 | (JP) . |
| 61-20075 | 1/1986 | (JP) . |
| 6-95550 | 4/1994 | (JP) . |
| 7-72776 | 3/1995 | (JP) . |
| 7-77851 | 3/1995 | (JP) . |
| 7-334061 | 12/1995 | (JP) . |
| 8-6346 | 1/1996 | (JP) . |
| 10-6583 | 1/1998 | (JP) . |

* cited by examiner

*Primary Examiner*—Quana Grainger
(74) *Attorney, Agent, or Firm*—Armstrong, Westerman Hattori, McLeland & Naughton

(57) ABSTRACT

The invention provides a double-sided printing apparatus which includes a first image forming process unit, a second image forming process unit, a first fixing station, a second fixing station and a transport system all disposed in a first housing. The transport system includes a transport direction changing element which contacts with one of surfaces of a medium to change the transporting direction of the medium so that the medium is sent out to the second fixing station. While the medium is transported in a substantially vertical direction in the single double-sided printing apparatus, the height of the transport path of the medium is suppressed so as not to become very high, thereby miniaturizing the apparatus. Further, intense light leaking from the fixing stations is intercepted so that deterioration of photosensitive drums of the image forming process units is prevented and a drop of the surface potentials of the photosensitive drums is prevented to extend the life of each photosensitive drum and prevent deterioration of the printing quality.

50 Claims, 12 Drawing Sheets

DOUBLE-SIDED PRINTING APPARATUS

BACKGROUND OF THE INVENTION

1) Field of the Invention

This invention relates to a double-sided printing apparatus suitable for use for electrophotographic printing on front and rear surfaces of continuous recording paper by a plurality of image forming stations and fixing stations disposed in a single apparatus.

2) Description of the Related Art

Conventionally, several techniques are used to print on front and rear surfaces of a recording medium (hereinafter referred to as medium) such as continuous recording paper by means of a printing apparatus of the electrophotographic type. For example, one of generally known techniques employs two single-sided printing apparatus (hereinafter referred to individually as first single-sided printing apparatus and second single-sided printing apparatus for convenience of description) each of which can print only on one surface of a medium and which are arranged in series along a transportation direction of a medium, and a reversing apparatus interposed between the two single-sided printing apparatus for reversing a medium between the front and rear surfaces.

According to the technique described above, one of the front and rear surfaces of a medium is first printed by the first single-sided printing apparatus, and then the medium is reversed by the reversing apparatus, whereafter the thus reversed medium is supplied to the second single-sided printing apparatus so that the other surface of the medium is printed by the second single-sided printing apparatus, thereby printing both of the front and rear surfaces of the medium.

Also a technique wherein double-sided printing of a medium is performed by a single printing apparatus is known. According to the technique, a medium is transported in a horizontal direction in the single apparatus, and an image forming process section for forming a toner image on an upper surface of the medium and a fixing station for fixing the toner image formed on the upper surface of the medium are disposed above the medium in the apparatus while another image forming process section for forming a toner image on a lower surface of the medium and another fixing station for fixing the toner image formed on the lower surface of the medium are disposed below the medium in the single apparatus such that printing on the two surfaces of the medium is performed while the medium is transported in the printing apparatus.

However, the conventional double-sided printing apparatus described above have the following subjects to be solved.

In particular, the double-sided printing apparatus which employs two single-sided printing apparatus has a subject to be solved in that, since it is necessary to dispose the two single-sided printing apparatus in a juxtaposed relationship with each other and dispose a reversing apparatus for reversing a medium between the two single-sided printing apparatus, the apparatus is large in size and particularly requires a large installation area.

On the other hand, in the double-sided printing apparatus wherein a medium is transported horizontally in the single apparatus and image forming process sections and fixing stations are arranged above and below the medium, since the image forming process sections are located above and below the medium, the image forming process section at the upper position and the image forming process section at the lower position exhibit different directions in which they contact with the medium, and consequently, the two image forming processing sections cannot be formed from common parts.

In particular, since conditions for formation of an image are different between the image forming process section which is disposed above the medium and forms a toner image on the upper surface of the medium and the image forming process section which is disposed below the medium and forms a toner image on the lower surface of the medium, setting conditions and arrangement conditions of parts of a developer, a precharger, an exposure member and so forth with respect to a photosensitive drum are different between the image forming process sections. Consequently, parts which compose the image forming process section disposed above the medium and parts which compose the image forming process section disposed below the medium have different constructions from each other.

Accordingly, since it is necessary to develop and produce two kinds of image forming process sections including the image forming process section to be disposed above the medium and the image forming process section to be disposed below the medium, there is a subject to be solved in that the cost and the time are required as much for development and so forth of them and a high production cost is required as much.

Further, since also consumables such as a developer, a developing unit itself and a photosensitive drum used in the two kinds of image forming process sections are different in construction from each other, two kinds of products must be prepared for each consumable. Consequently, also the expense and the time are required as much for development and so forth of the consumables and a high production cost is required as much. Further, there is a subject to be solved that, upon replacement of the consumables, the operator must pay attention so as not to mistake which one of two kinds of consumables should be used, and time is required as much.

Also a further double-sided printing apparatus is known which solves the subjects described above by forming two image forming process sections in a common construction. To this end, according to the double-sided printing apparatus, a medium is transported in a substantially vertical direction (such transportation is hereinafter referred to as vertical transportation) in the single printing apparatus and image forming process sections and fixing sections are disposed adjacent the opposite surfaces of the medium so that the imaging forming process sections and the fixing sections may be individually composed of common parts.

However, continuous paper which is used as a medium in a printing apparatus is used for high speed printing (for example, approximately 8,000 lines/minute for one surface) from its advantages that it is less likely to suffer from paper jamming upon transportation thereof, that it does not require such an operation as picking, and so forth. And, in order to allow such high speed printing in a printing apparatus, the diameters of a photosensitive drum and a developing roller of an image forming process section must be large. Thus, the conventional double-sided printing apparatus wherein a medium is transported vertically in the single apparatus has a subject to be solved in that, if the apparatus is constructed merely such that a medium is transported vertically and image forming process sections and fixing sections are successively disposed in the vertical direction on the opposite sides of the medium, then it has a great vertical dimension or height.

Where the height of the apparatus is great, it follows that some part of the medium is transported at a high position.

This makes it difficult to perform an operation for a medium such as, for example, an operation of removing jamming paper (medium) when paper jamming or the like occurs. Further, since also a printing unit such as an image forming process section or a fixing station is disposed at a high position, such an operation as maintenance or checking cannot be performed readily, resulting in a subject that the workability is low. Therefore, where the workability is taken into consideration, the height of the apparatus is preferably set so that the operator can operate the apparatus readily by hand (for example, approximately 1,500 mm).

Meanwhile, in printing by electrophotography, as a fixing unit for fixing a toner image formed on a medium by each image forming process section, a fixing unit including heat rollers which contact with and are driven to rotate by a medium being transported, a flash fixing unit for fixing a toner image by means of a flash lamp such as a xenon lamp or some other fixing unit is used.

In a fixing unit which includes heat rollers, when a medium is held by and between the heat rollers and is transported in order to perform fixing, the temperature of the heat rollers drops. Further, if the medium is transported at a high speed in order to assure a high printing speed, then the temperature of the heat rollers drops remarkably. This makes it difficult to maintain a desired temperature for fixing of a toner image and hence to maintain the printing quality. Further, since the heat rollers of a high temperature are pressed against the medium upon fixing, there is the possibility that the medium may be damaged.

On the other hand, a flash fixing unit exhibits a less influence upon a medium than a fixing unit which employs heat rollers. However, since flash light of the flash fixing unit is very intense, there is a subject to be solved in that light leaking from between a gap between the flash fixing unit and the medium or the like is irradiated upon photosensitive drums of image forming process sections and the photosensitive drums are optically deteriorated by the leaking light, resulting in reduction of the life of the photosensitive drums. Further, local optical deterioration of the photosensitive drums by the leaking light causes an irregular printing density, resulting in deterioration of the printing quality. Further, the leaking light drops the surface potentials of the photosensitive drums. Also this gives rise to a subject to be solved in that the printing quality is deteriorated.

Particularly around a portion of a transport path of a medium in the apparatus where the medium does not pass, leaking light from a flash fixing unit is not interrupted by the medium or some other element, and this intense leaking light is directly irradiated upon the photosensitive drums. Therefore, deterioration of the photosensitive drums, a drop of the surface potentials and so forth are likely to occur remarkably.

Further, in a double-sided printing apparatus in which flash fixing is involved, toner powder transferred to printing surfaces of a medium is heated upon emission of flash light by fixing units, and smoke, odor and so forth composed of high molecular organic substances such as styrene, butadiene and phenol are produced from around the fixing units. Therefore, in a double-sided printing apparatus which employs flash fixing, in order to remove such smoke and so forth, gas discharging processing apparatus including ducts, fans and activated carbon filters are provided individually for a fixing unit for a recording medium front surface and a fixing unit for a recording medium rear surface so that smoke and so forth generated may be attracted and discharged by the gas discharging processing apparatus.

However, in a double-sided printing apparatus which employs flash fixing, in order to detect timings at which the activated carbon filters should be replaced, pressure sensors or the like are provided for the individual filters, and choking of the activated carbon filters is detected from detection values of the pressure sensors to discriminate the timing for replacement. However, since the frequency of use is different between the fixing unit for the front surface and the fixing unit for the rear surface of the medium, it is necessary to provide pressure sensors or the like for both of the filter attached to the fixing unit for the front surface and the filter attached to the fixing unit for the rear surface of the medium and supervise the pressure sensors separately from each other. Consequently, there is a subject to be solved in that a high production cost is required for the apparatus as much.

SUMMARY OF THE INVENTION

It is an object of the present invention to provide a double-sided printing apparatus which, while a medium is transported substantially in a vertical direction in the single double-sided printing apparatus, is small in size with a transport path for a medium kept positioned at a comparatively low position.

It is another object of the present invention to provide a double-sided printing apparatus which prevents deterioration of photosensitive drums of image forming process units and a drop of surface potentials of the photosensitive drums caused by intense light leaking from fixing units to assure a long life of the photosensitive drums and prevent deterioration of the printing quality.

In order to attain the objects described above, according to an aspect of the present invention, there is provided a double-sided printing apparatus for printing on a front surface and a rear surface of a medium, comprising a first image forming process unit for forming a toner image on the rear surface of the medium, a second image forming process unit disposed above the first image forming process unit for forming a toner image on the front surface of the medium, a first fixing station disposed above the second image forming process unit for fixing the toner image formed on one of the front and rear surfaces of the medium, a second fixing station disposed at a position different from that of the first fixing station for fixing the toner image formed on the other surface of the medium, a transport system for transporting the medium successively to the first image forming process unit, second image forming process unit, first fixing station and second fixing station, and a medium stacking section for stacking the medium after printed, the first image forming process unit, second image forming process unit, first fixing station, second fixing station and transport system being disposed in a first housing, the transport system including a transport direction changing element for changing a transporting direction of the medium between the first fixing station and the second fixing station, the transport direction changing element contacting with one of the surfaces of the medium to change the transporting direction of the medium to send out the medium to the second fixing station.

With the double-sided printing apparatus, since it includes the first image forming process unit, second image forming process unit, first fixing station, second fixing station, transport system, medium stacking section and transport direction changing element, double-sided printing of a medium can be performed by the single apparatus. Further, since the transport direction changing element contacts with one of the surfaces of the medium to change the transporting direction of the medium to send out the medium to the second fixing station, the apparatus is advantageous in that the height thereof can be made low and the apparatus can be miniaturized and besides the operability of an operator can be augmented.

The first image forming process unit and the second image forming process unit may be composed of common parts to each other. This allows common use of parts for the first imaging forming process unit and the second image forming process unit and consumables and so forth for use with them. Consequently, the double-sided printing apparatus is advantageous in that the cost required for development of a product and the production cost can be reduced.

The first fixing station and the second fixing station may be composed of common components to each other.

This allows common use of parts of the first fixing station and the second fixing station and consumables and so forth for use with them. The double-sided printing apparatus is advantageous in that the cost required for development of a product and the production cost can be reduced.

The double-sided printing apparatus may be constructed such that the transport direction changing element includes a transport direction changing roller which contacts with one of the surfaces of the medium and rotates in the transporting direction of the medium, and the medium is wrapped over a predetermined angle around the transport direction changing roller. The double-sided printing apparatus is advantageous in that the transporting direction changing element can be implemented economically with a simple construction.

The transport system may include a turn-around element for changing the transporting direction of the medium between the second image forming process unit and the first fixing station. The transport system can prevent light leaking from the first fixing station and the second fixing station from being irradiated upon photosensitive drums of the first image forming process unit and the second image forming process unit. Consequently, the double-sided printing apparatus is advantageous in that reduction of the life of each of the photosensitive drums by optical deterioration can be prevented and deterioration of the printing quality by a drop of the surface potentials of the photosensitive drums can be prevented.

The double-sided printing apparatus may be constructed such that the turn-around element includes a turn-around roller which contacts with the medium and rotates in the transporting direction of the medium, and the medium is wrapped over a predetermined angle around the turn-around roller. The double-sided printing apparatus is advantageous in that the turn-around element can be implemented with a simple construction and the medium can be transported without disturbing a toner image formed on the medium.

The double-sided printing apparatus may be constructed such that an angle defined between a transport path of the medium in the first fixing station and a transport path of the medium in the second fixing station is equal to or greater than a predetermined angle. The double-sided printing apparatus is advantageous in that the height thereof can be made low and the apparatus can be formed with a small size and also in that, between the first fixing station and the second fixing station, light leaking from one of the fixing stations which is disposed on the downstream side can be intercepted.

The double-sided printing apparatus may be constructed such that an angle defined between a transport path of the medium in the second image forming process unit and the transport path of the medium in the second fixing station is equal to or greater than a predetermined angle. The construction of the double-sided printing apparatus can prevent light leaking from the first fixing station from being irradiated upon photosensitive drums of the first image forming process unit and the second image forming process unit. Consequently, the double-sided printing apparatus is advantageous in that reduction of the life of each of the photosensitive drums by optical deterioration can be prevented and deterioration of the printing quality by a drop of the surface potentials of the photosensitive drums can be prevented.

The double-sided printing apparatus may be constructed such that the medium stacking section, a blower for collecting smoke generated from the first fixing station and the second fixing station and discharging the smoke to the outside, and a power supply section for operating the first fixing station and the second fixing station are disposed in a second housing, and the medium stacking section is disposed adjacent the first housing with respect to the blower and the power supply section. With the double-sided printing apparatus, the lengths of the transport paths from the first image forming process unit and the second image forming process unit to the medium stacking section can be made short. Consequently, the double-sided printing apparatus is advantageous in that the range of data compensation by a host apparatus when some trouble occurs in printing can be made small and the reliability of the apparatus can be augmented.

The double-sided printing apparatus may be constructed such that the lengths of transport paths of the medium between the first image forming process unit and the medium stacking section and between the second image forming process unit and the medium stacking section are within a range within which data compensation is possible by a host apparatus which demands printing. The double-sided printing apparatus is advantageous in that, when some trouble occurs in printing, the apparatus can be re-set with certainty by a host apparatus and the reliability of the apparatus can be augmented.

The transport system may be disposed on the upstream side of the first image forming process unit and include a plurality of tractor mechanisms common to each other for transporting the medium. The double-sided printing apparatus is advantageous in that the operability when a medium is to be mounted into the apparatus can be augmented and the medium can be transported with certainty and consequently the reliability of the apparatus can be augmented. Further, since the plurality of common tractor mechanisms are employed, the double-sided printing apparatus is advantageous also in that the production cost for the tractor mechanisms can be reduced.

In this instance, the double-sided printing apparatus may be constructed such that the plurality of tractor mechanisms are driven by a same driving source or alternatively such that the plurality of tractor mechanisms are driven by driving sources which are independent of each other, and the driving sources drive the tractor mechanisms in synchronism with each other. With the double-sided printing apparatus, the tractor mechanisms can be driven in synchronism with each other with certainty and the medium can be transported stably. Consequently, the reliability of the apparatus can be augmented.

Further, the double-sided printing apparatus may be constructed such that the plurality of tractor mechanisms and the driving source or sources are capable of transporting the medium in any one of a transporting direction for printing and a direction opposite to the transporting direction. With the double-sided printing apparatus, when some trouble such as jamming of the medium occurs, in order to perform, as a re-setting operation, printing for the location with which the trouble has occurred, the medium can be transported in the direction opposite to the transporting direction for printing to resume printing from a desired position of the medium. Consequently, the double-sided printing apparatus is advantageous in that the reliability of the apparatus can be augmented.

Further, the double-sided printing apparatus may be constructed such that, when the plurality of tractor mechanisms transport the medium in the opposite direction, the medium is transported at a speed higher than a transporting speed for printing. The double-sided printing apparatus is advantageous in that, when a re-setting operation is performed because of occurrence of some trouble such as paper jamming or the like, printing can be resumed rapidly.

The double-sided printing apparatus may further comprise a medium tensioning element provided on the upstream side of one of the plurality of tractor mechanisms which is disposed on the most downstream side for exerting a tension to act upon the medium in the direction opposite to the transporting direction for printing of the medium. The double-sided printing apparatus is advantageous in that, upon transportation of the medium by the transport system, the medium can always be kept taut without being slackened between the first image forming process unit and the second image forming process unit at all and high quality printing can be achieved.

In this instance, the double-sided printing apparatus may be constructed such that the medium tensioning element includes at least one pair of tensioning rollers disposed in an opposing relationship to each other with the medium interposed therebetween, and the double-sided printing apparatus further comprises a roller driving source for driving the driving side tensioning roller, which is one of the pair of tensioning rollers, to rotate while the driven side tensioning roller which is the other of the pair of tensioning rollers is driven by the medium being transported. The double-sided printing apparatus is advantageous in that the medium tensioning element can be implemented economically with a simple construction.

Further, the double-sided printing apparatus may be constructed such that the roller driving source is capable of driving the driving side tensioning roller to rotate in any of the transporting direction for printing of the medium and the direction opposite to the transporting direction. With the double-sided printing apparatus, upon transportation of the medium in the direction opposite to the transporting direction for printing, the medium can always be kept taut without being slackened during transportation. Consequently, the double-sided printing apparatus is advantageous in that occurrence of such a trouble as jamming can be prevented and the reliability of the apparatus can be augmented.

Furthermore, the double-sided printing apparatus may be constructed such that the roller driving source drives, when the medium is to be transported in the transporting direction for printing, the driving side tensioning roller to rotate such that a circumferential speed of the driving side tensioning roller is lower than the transporting speed for printing of the medium in the transporting direction for printing of the medium. With the double-sided printing apparatus, since a tension is exerted on the medium in the direction opposite to the transporting direction for printing, the medium can always be kept taut without being slackened in the first image forming process unit, the second image forming process unit and so forth. Consequently, the double-sided printing apparatus is advantageous in that high quality printing can be achieved and occurrence of such a trouble as jamming can be prevented, and consequently, the reliability of the apparatus can be augmented.

The double-sided printing apparatus may be constructed such that the roller driving source drives, when the medium is to be transported in the direction opposite to the transporting direction for printing, the driving side tensioning roller to rotate such that a circumferential speed of the driving side tensioning roller is higher than the transporting speed for printing of the medium in the direction opposite to the printing direction for printing of the medium. With the double-sided printing apparatus, since a tension is exerted on the medium in the transporting direction for printing, the medium can always be kept taut without being slackened in the transport path of the medium. Consequently, the double-sided printing apparatus is advantageous in that occurrence of such a trouble as jamming can be prevented and the reliability of the apparatus can be augmented.

The double-sided printing apparatus may be constructed such that a one-way clutch is interposed between the roller driving source and the driving side tensioning roller. With the double-sided printing apparatus, when the medium is to be transported at a high speed in the transporting direction for printing in order to perform replacement of the medium or the like, even if the driving side tensioning roller is compulsorily rotated in the transporting direction for printing by a frictional force which is exerted between the driving side tensioning roller and the medium or a like force, an excessive force is prevented from being applied to a drive motor of the roller driving source. Consequently, the double-sided printing apparatus is advantageous in that otherwise possible occurrence of a failure or the like can be prevented and the reliability of the apparatus can be augmented.

The double-sided printing apparatus may be constructed such that the driven side tensioning roller is mounted for movement into and out of contact with the medium, and when the medium is to be transported in the transporting direction for printing, the driven side tensioning roller is brought into contact with the medium, but when the medium is to be transported in the direction opposite to the transporting direction for printing, the driven side tensioning roller is brought out of contact with the medium. With the double-sided printing apparatus, no friction occurs between the medium and the driven side tensioning roller. Consequently, the double-sided printing apparatus is advantageous in that abrasion of the driven side tensioning roller can be prevented.

The double-sided printing apparatus may be constructed such that the first fixing station and the second fixing station perform flash fixing. With the double-sided printing apparatus, when compared with fixing which employs a fixing unit including heat rollers for a medium, no influence is had on the medium upon fixing, and also when high speed continuous printing is performed, the fixing capacity can be maintained. Consequently, the double-sided printing apparatus is advantageous in that high quality printing can be achieved also in high speed continuous printing.

The double-sided printing apparatus may be constructed such that each of the first image forming process unit and the second image forming process unit includes a developing unit removably mounted thereon, and, when the developing unit is to be mounted or removed, the developing unit of the first image forming process unit and the developing unit of the second image forming process unit are movable in directions different from each other. With the double-sided printing apparatus, when some trouble such as paper jamming occurs, a maintenance space around the photosensitive drums can be assured. Consequently, the double-sided printing apparatus is advantageous in that the working efficiency in a maintenance operation and so forth can be augmented.

Further, the double-sided printing apparatus may be constructed such that, when any of the developing units is to be mounted or removed, the developing unit moves in association with a paper jamming processing mechanism. With the double-sided printing apparatus, a maintenance space around the photosensitive drums can be assured readily. Consequently, the double-sided printing apparatus is advantageous in that the working efficiency in a maintenance operation and so forth can be augmented.

The double-sided printing apparatus may be constructed such that each of the first image forming process unit and the second image forming process unit includes a cleaner unit for collecting waste toner powder, and further includes a waste toner screw for discharging the waste toner powder collected by the cleaner unit, a screw driving source for driving the waste toner screw to rotate, and a waste toner collector for collecting the waste toner powder discharged when the waste toner screw is driven to rotate by the screw driving source. With the double-sided printing apparatus, waste toner powder collected from the first image forming process unit and the second image forming process unit can be collected readily. Consequently, the double-sided printing apparatus is advantageous in that the operability in a maintenance operation can be augmented.

In this instance, a toner cartridge after used may be re-used as the waste toner collector. This eliminates the necessity for development/production of a waste toner collector for exclusive use. Consequently, the production cost can be reduced and besides the operation cost can be reduced.

The double-sided printing apparatus may be constructed such that single-sided printing is performed using the second image forming process unit, second fixing station and transport system. This makes it possible to use parts commonly between the double-sided printing apparatus and the single-sided printing apparatus. Consequently, the double-sided printing apparatus is advantageous in that the time and the cost required for development/production can be reduced.

The double-sided printing apparatus may be constructed such that a light intercepting member for intercepting light leaking from at least one of the first fixing station and the second fixing station to prevent the leaking light from arriving at the first image forming process unit and the second image forming process unit is disposed at a medium non-passing location in the proximity of at least one of the first fixing station and the second fixing station. The double-sided printing apparatus is advantageous in that optical deterioration of the photosensitive drum of at least one of the first image forming process unit and the second image forming process unit by light leaking through the medium non-passing location can be prevented and deterioration of the printing quality by a drop of the surface potential of the photosensitive drum can be prevented.

The double-sided printing apparatus may be constructed such that a light intercepting member having a length greater than a length of a photosensitive drum of the first image forming process unit or one of the first fixing station and the second fixing station, which is disposed adjacent the rear surface of the medium, in a widthwise direction of the medium for intercepting light leaking from the one fixing station to prevent the leaking light from arriving at the first image forming process unit is disposed between the first image forming process unit and the one fixing station, and another light intercepting member having a length greater than a length of a photosensitive drum of the second image forming process unit or the other one of the first fixing station and the second fixing station, which is disposed adjacent the front surface of the medium, in the widthwise direction of the medium for intercepting light leaking from the other fixing station to prevent the leaking light from arriving at the second image forming process unit is disposed between the second image forming process unit and the other fixing station. With the double-sided printing apparatus, since the light intercepting member having a length greater than the length of the photosensitive drum of the first image forming process unit or one of the first fixing station and the second fixing station, which is disposed adjacent the rear surface of the medium, in a widthwise direction of the medium for intercepting light leaking from the one fixing station to prevent the leaking light from arriving at the first image forming process unit is disposed between the first image forming process unit and the one fixing station, leaking light from the fixing station disposed on the rear surface side of the medium does not arrive at the photosensitive drum of the first image forming process unit. Consequently, the double-sided printing apparatus is advantageous in that optical deterioration of the photosensitive drum of the first image forming process unit by leaking light can be prevented and besides it can be prevented that the surface potential of the photosensitive drum drops to deteriorate the printing quality. Further, since the light intercepting member having a length greater than the length of the photosensitive drum of the second image forming process unit or the other one of the first fixing station and the second fixing station, which is disposed adjacent the front surface of the medium, in the widthwise direction of the medium for intercepting light leaking from the other fixing station to prevent the leaking light from arriving at the second image forming process unit is disposed between the second image forming process unit and the other fixing station, leaking light from the fixing station disposed on the rear surface side of the medium does not arrive at the photosensitive drum of the first image forming process unit. Consequently, the double-sided printing apparatus is advantageous in that optical deterioration of the photosensitive drum of the first image forming process unit by leaking light can be prevented, and accordingly, the printing quality can be augmented.

In the double-sided printing apparatus, the one light intercepting member or each of the light intercepting members may be formed from a member having a low light transmittivity or from a member having a low light reflection factor, or formed from a member having a high light refection factor at a portion thereof adjacent the corresponding fixing station, or else the one light intercepting member or each of the light intercepting members may include a light intercepting roller which is capable of contacting with and being rotated by the medium as the medium is transported.

Where each of the light intercepting members is formed from a member having a low light transmittivity, leaking light from the fixing stations can be intercepted with certainty. Consequently, the double-sided printing apparatus is advantageous in that the printing quality can be augmented.

Where each of the light intercepting members is formed from a member having a low light reflection factor, irregular reflection of light by the light intercepting members can be prevented. Consequently, the double-sided printing apparatus is advantageous in that the printing quality can be augmented.

Where the light reflection factor of each of the light intercepting members is higher at a portion thereof adjacent the corresponding fixing station, the flash energy utilization efficiencies of the fixing stations can augmented and heating of the light intercepting members can be prevented. Consequently, the double-sided printing apparatus is advantageous in that thermal deterioration of the light intercepting members can be prevented.

Where each of the light intercepting members includes a light intercepting roller which is capable of contacting with and being rotated by the medium as the medium is transported, the double-sided printing apparatus is advantageous in that the light intercepting members can be implemented with a simple construction.

The double-sided printing apparatus may be constructed such that the first fixing station performs flash fixing, and the turn-around roller serves also as a light intercepting roller as a light intercepting member which intercepts light leaking from the first fixing station to prevent the leaking light from arriving at the second image forming process unit. This allows reduction of the number of parts which compose the apparatus. Consequently, the double-sided printing apparatus is advantageous in that the production cost can be reduced.

The double-sided printing apparatus may further comprise a pair of shaft elements disposed at positions opposing each other with the medium interposed therebetween in a widthwise direction of the medium and extending in parallel to each other in a direction perpendicular to a plane in which the medium is transported, a belt-like member extending in an endless fashion between and around the pair of shaft elements and serving as the light intercepting member, the belt-like member having a narrower portion capable of allowing passage of the medium and a wider portion capable of intercepting light leaking from the fixing station, the belt-like member being circulated around the pair of shaft elements so that light to pass the medium no-passing location is intercepted by the wider portion of the belt-like member in accordance with the width of the medium. With the double-sided printing apparatus, light leaking from the fixing stations is prevented from arriving at the photosensitive drums of the second image forming process unit and the first image forming process unit. Consequently, the double-sided printing apparatus is advantageous in that optical deterioration of the photosensitive drum of the first image forming process unit by leaking light can be prevented and the printing quality can be augmented.

The double-sided printing apparatus may be constructed such that the belt-like member is formed from a member having a low light transmittivity or from a member having a low light reflection factor.

Where the belt-like member is formed from a member having a low light transmittivity, light leaking from the fixing stations can be intercepted with certainty. Consequently, the double-sided printing apparatus is advantageous in that the printing quality can be augmented.

Where the belt-like member is formed from a member having a low light reflection factor, irregular reflection of light by the light intercepting members can be prevented. Consequently, the double-sided printing apparatus is advantageous in that the printing quality can be augmented.

The double-sided printing apparatus may be constructed such that a surface of the belt-like member adjacent the fixing station is formed from a member having a high light reflection factor. The double-sided printing apparatus is advantageous in that the flash energy utilization efficiencies of the fixing stations is augmented, and since heating of the light intercepting members can be prevented, thermal deterioration of them can be prevented.

The double-sided printing apparatus may be constructed such that the second fixing station performs flash fixing, and the transporting direction changing roller serves also as the light intercepting roller as a light intercepting member which intercepts light leaking from the second fixing station to prevent the leaking light from arriving at the second image forming process unit. The double-sided printing apparatus is advantageous in that the number of parts which compose the apparatus can be reduced and the production cost can be reduced.

The double-sided printing apparatus may further comprise a cooling mechanism for cooling the light intercepting member. By the cooling mechanism, heating of the light intercepting member can be prevented. Consequently, the double-sided printing apparatus is advantageous in that thermal deterioration of the light intercepting member can be prevented.

According to another aspect of the present invention, there is provided a double-sided printing apparatus for printing on a front surface and a rear surface of a medium, comprising a first image forming process unit for forming a toner image on the rear surface of the medium, a second image forming process unit disposed above the first image forming process unit for forming a toner image on the front surface of the medium, a first fixing station disposed above the second image forming process unit for fixing the toner image formed on one of the front and rear surfaces of the medium, a second fixing station disposed at a position different from that of the first fixing station for fixing the toner image formed on the other surface of the medium, a medium stacking section for stacking the medium after printed, the first image forming process unit, second image forming process unit, first fixing station and second fixing station being disposed in a first housing, and a transport direction changing element for changing a transporting direction of the medium on the downstream of the first image forming process unit and the second mage forming process unit, the transport direction changing element contacts with one of the surfaces of the medium to change the transporting direction of the medium.

With the double-sided printing apparatus, the transport direction changing element contacts with one of the surfaces of the medium to change the transporting direction of the medium on the downstream of the first image forming process unit and the second image forming process unit. Consequently, the double-sided printing apparatus is advantageous in that the height thereof can be made low and the apparatus can be miniaturized similarly and besides the operability of an operator can be augmented.

The above and other objects, features and advantages of the present invention will become apparent from the following description and the appended claims, taken in conjunction with the accompanying drawings in which like parts or elements denoted by like reference symbols.

DESCRIPTION OF THE PREFERRED EMBODIMENT

A. Basic Construction of an Embodiment of the Invention

A double-sided printing apparatus according to a preferred embodiment of the present invention is connected to a host apparatus such as a host computer and transports, in accordance with a printing instruction from the host apparatus, a recording medium (hereinafter referred to as medium) such as continuous recording paper, which is an object of printing, and performs printing on the opposite surfaces of the medium by electrophotography.

Figure 1:
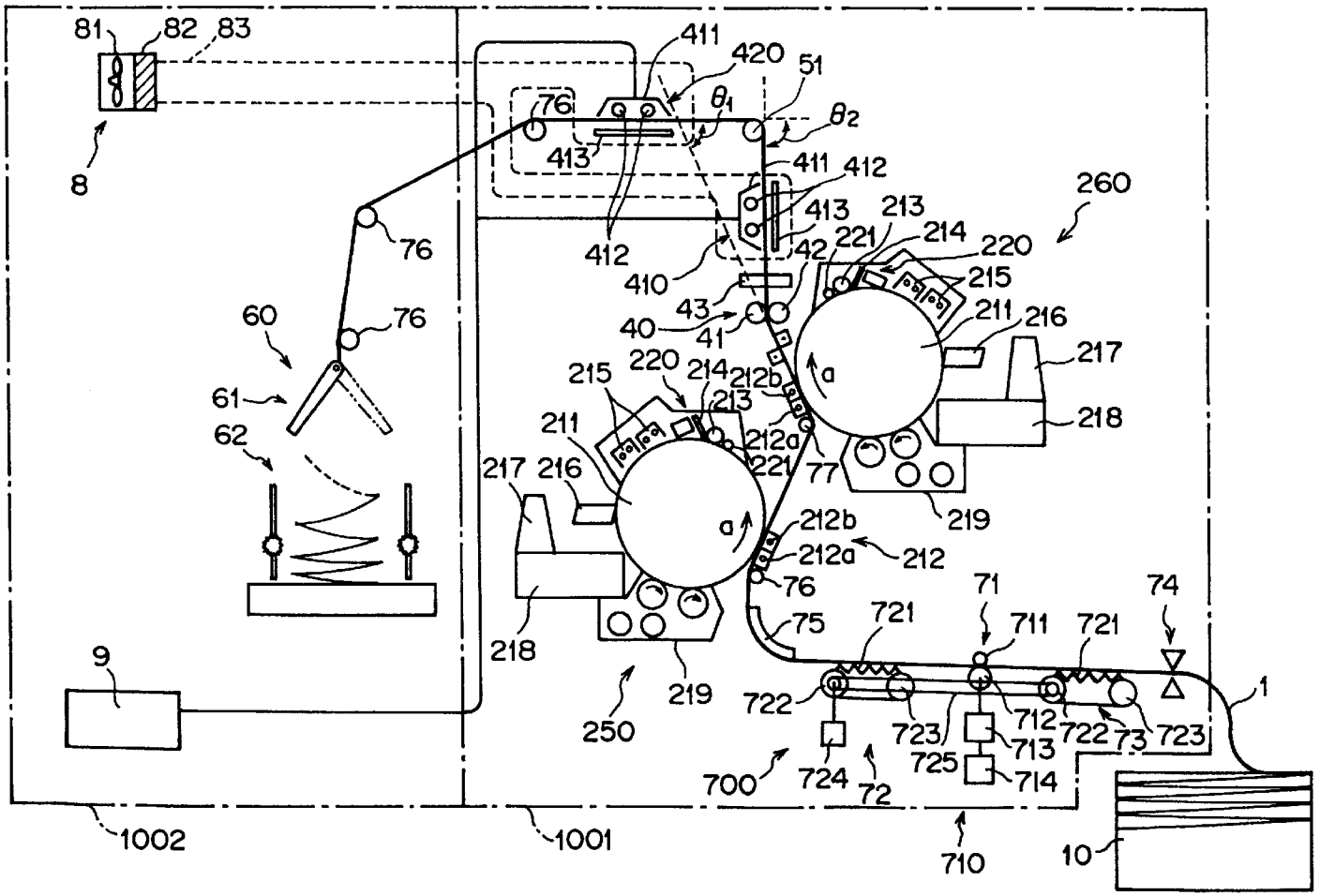
FIG. 1 is a side elevational view schematically showing a construction of a double-sided printing apparatus according to a preferred embodiment of the present invention.

FIG. 1 schematically shows a construction of the double-sided printing apparatus according to the preferred embodiment of the present invention. Referring to FIG. 1, the double-sided printing apparatus includes a paper hopper 10, a transport system 700, a first transfer process unit (first image forming process unit) 250, a second transfer process unit (second image forming process unit) 260, a first fixing station 410, a second fixing station 420, a stacker (medium stacking section) 60, a blower 8, and a flash fixing unit power supply (power supply section) 9.

The paper hopper 10 holds a non-printed medium 1 in a self-folded condition and successively supplies it to the double-sided printing apparatus. The operator will install a non-printed medium 1 into the paper hopper 10 before printing is started.

The medium 1 is continuous recording paper on which perforations are formed at predetermined distances thereof and has feed holes formed equidistantly on the opposite side portions thereof.

The first transfer process unit 250 electrophotographically transfers a toner image to the rear surface of the medium 1 under the control of a control apparatus not shown and is composed of various parts including a photosensitive drum 211, an exposure LED 216, prechargers 215, a cleaning section 220 and a developing unit 219 with a toner hopper.

The photosensitive drum 211 rotates, upon printing, in a direction indicated by an arrow mark a in FIG. 1 while it is held in contact with the medium 1. A toner image is formed on a circumferential surface of the photosensitive drum 211 and transferred to the medium 1 while the photosensitive drum 211 is held in contact with and driven to rotate by the medium 1.

The cleaning section 220 which is a cleaner unit for collecting waste toner powder (remaining toner powder) on the surface of the photosensitive drum 211 is disposed around the outer periphery of and above the photosensitive drum 211.

Figure 2:
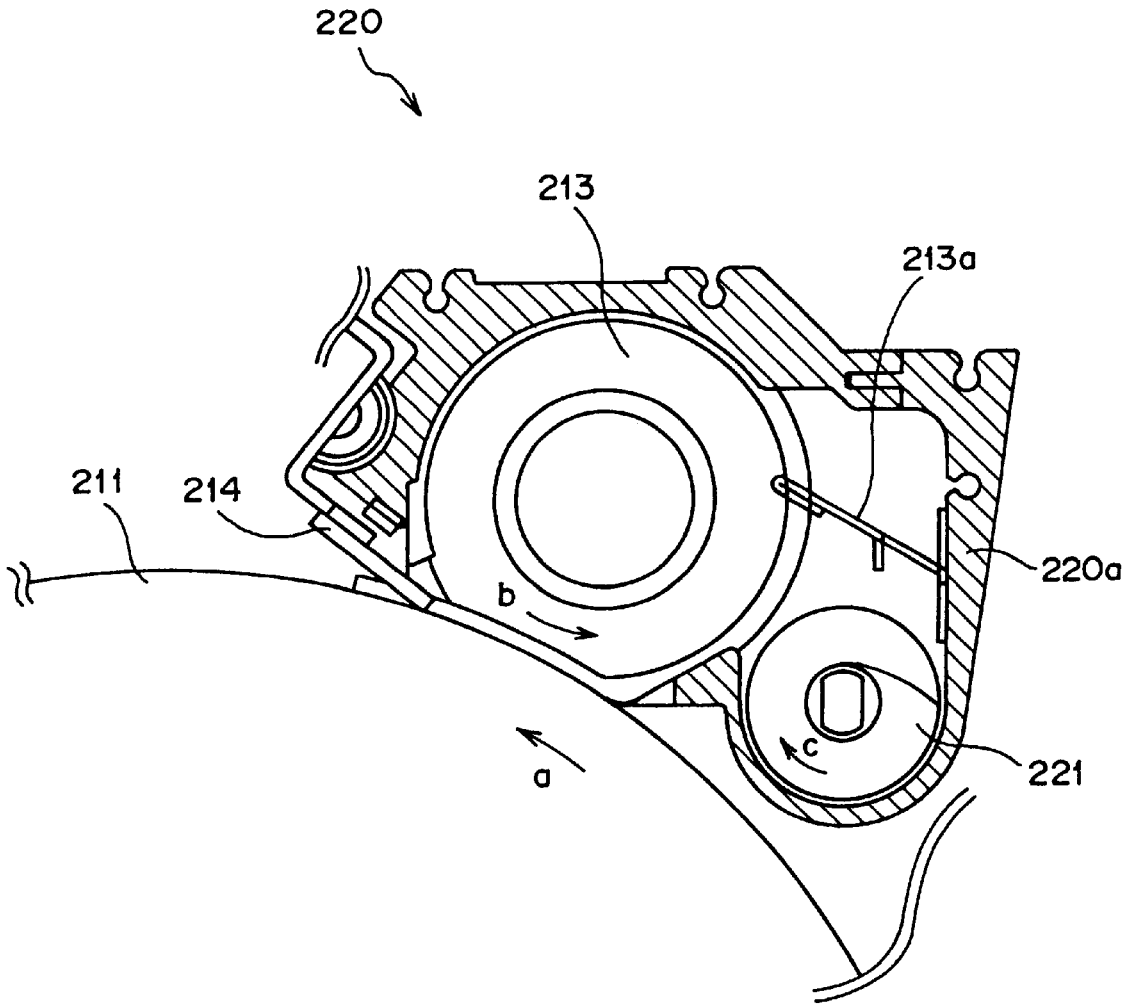
FIG. 2 is a side elevational view schematically showing a construction of a cleaning section of the double-sided printing apparatus shown in FIG. 1.

FIG. 2 schematically shows a construction of the cleaning section 220. Referring to FIGS. 1 and 2, the cleaning section 220 includes a fixed pressure blade 214, a cleaning brush 213 and a waste toner screw 221.

The fixed pressure blade 214 is in contact at a predetermined angle with the surface of the photosensitive drum 211 over the entire range in an axial direction of the photosensitive drum 211. When the photosensitive drum 211 rotates in one direction (the direction indicated by an arrow mark a in FIGS. 1 and 2) while it is in contact with the fixed pressure blade 214, the contacting portion of the fixed pressure blade 214 exfoliates remaining toner powder sticking to the surface of the photosensitive drum 211 from the surface of the photosensitive drum 211.

The cleaning brush 213 is disposed on the upstream side of the fixed pressure blade 214 (on the right side in FIG. 2) along the surface of the photosensitive drum 211 and extends over the entire range in a widthwise direction of the photosensitive drum 211 such that it contacts with the surface of the photosensitive drum 211. The cleaning brush 213 is rotated in a direction opposing to the rotation of the photosensitive drum 211 in the direction of the arrow mark a, that is, rotated in the direction indicated by another arrow mark b in FIG. 2 while it is in contact with the surface of the photosensitive drum 211 so that it conveys the remaining toner powder exfoliated from the surface of the photosensitive drum 211 by the fixed pressure blade 214 to the waste toner screw 221.

On the upstream side of the cleaning brush 213 along the outer periphery of the photosensitive drum 211, a scraping off plate **213*a* is provided fixedly and extends over the entire range in an axial direction of the photosensitive drum 211 in such a manner that it sticks or extends into the cleaning brush 213. Below the scraping off plate 213*a*, the waste toner screw 221 is disposed in parallel to the photosensitive drum 211. The waste toner screw 221 is driven to rotate in a predetermined direction (direction of an arrow mark c in FIG. 2**) by a drive motor (screw driving source) not shown.

At a position adjacent an end portion of the waste toner screw 221 on the downstream side of the photosensitive drum 211 when the waste toner screw 221 is driven to rotate in the direction of the arrow mark c, a toner cartridge (217) used already is disposed as a waste toner collector (not shown) so that waste toner powder transported by rotation of the waste toner screw 221 in the direction of the arrow mark c drops into and is collected by the waste toner collector.

It is to be noted that, since the cleaning section 220 is surrounded by a cover **220*a*, remaining toner powder exfoliated by the fixed pressure blade 214 does not drop onto the photosensitive drum 211** until it is collected into the waste toner collector.

In particular, remaining toner powder on the surface of the photosensitive drum 211 is conveyed by the cleaning brush 213 after it is exfoliated from the surface of the photosensitive drum 211 by the fixed pressure blade 214. The waste toner powder conveyed by the cleaning brush 213 is scraped off by the scraping off plate 213*a* and drops onto the waste toner screw 221.

Then, the waste toner powder is conveyed by the waste toner screw 221 being rotated and drops at the end of the waste toner screw 221 so that it is collected into the waste toner collector disposed below the end of the waste toner screw 221.

A plurality of (two in the present embodiment) prechargers 215 are disposed at a position on the downstream side of the cleaning section 220 along the outer periphery of the photosensitive drum 211. The surface of the photosensitive drum 211 is charged uniformly by the prechargers 215.

The exposure LED 216 is disposed at a position on the downstream side of the prechargers 215 along the outer periphery of the waste toner screw 221. The exposure LED 216 is formed from an LED head or a like member and serves as an exposure optical unit which irradiates an optical image corresponding to an image to be printed upon the surface of the photosensitive drum 211 to form an electrostatic latent image.

At a position on the downstream side of the exposure LED 216 along the outer periphery of the photosensitive drum 211, the developing unit 219 with a toner hopper is disposed which develops an electrostatic latent image formed by the exposure LED 216 to form a toner image. A toner hopper 218 for supplying developing toner powder is attached to the developing unit 219 with a toner hopper, and a toner cartridge 217 which contains developing toner powder therein is removably attached to the toner hopper 218.

The developing unit 219 with a toner hopper includes a developer counter not shown which counts up each time printing is performed.

Then, a result of the counting by the developer counter is sent to the control apparatus not shown.

The photosensitive drum 211 contacts with the medium 1 at a position on the downstream side of the developing unit 219 with a toner hopper along the outer periphery of the photosensitive drum 211, and at the contacting position, a transfer station 212 including a transfer charger 212*a* and a separation charger 212*b* is disposed in an opposing relationship to the photosensitive drum 211 with the medium 1 interposed therebetween.

The transfer charger 212*a* generates, at the contacting position between the photosensitive drum 211 and the medium 1, corona discharge with a potential of the opposite polarity to that of a potential of the charge of the toner image from the rear side of the medium 1 to charge the medium 1 so that a toner image may be attracted and transferred to the medium 1. On the other hand, on the downstream side along the transport route of the medium 1 adjacent the transfer charger 212*a*, the separation charger 212*b* for removing the charge of the medium 1 to facilitate separation of the medium 1 from the photosensitive drum 211 is disposed.

Meanwhile, the photosensitive drum 211 from which a toner image formed on the surface thereof has been transferred to the rear surface of the medium 1 is acted upon by the cleaning section 220 so that remaining toner power on the surface thereof is removed again.

The second transfer process unit 260 is disposed for contacting with the front surface of the medium 1 above the first transfer process unit 250 and forms a toner image on the front surface of the medium 1. The second transfer process unit 260 has a construction common to that of the first transfer process unit 250 and is disposed in such a posture that the second transfer process unit 260 and the first transfer process unit 250 are symmetrical with respect to a vertical plane with the medium 1 interposed therebetween.

It is to be noted that detailed description of the second transfer process unit 260 is omitted here to avoid redundancy as the second transfer process unit 260 has a common construction to that of the first transfer process unit 250 as mentioned above.

Both of the first fixing station 410 and the second fixing station 420 fix toner images formed on the medium 1 with flash and each includes flash lamps 412 which may be xenon lamps or the like, a reflecting mirror 411 and an opposing reflecting plate 413. The first fixing station 410 and the second fixing station 420 have a common construction to each other.

In particular, in each of the first fixing station 410 and the second fixing station 420, the flash lamps 412 are disposed on the side to which a non-fixed toner image on the medium 1 is to be fixed, and the reflecting mirror 411 is disposed at a location at which the medium 1 is not present around the flash lamps 412 so as to reflect flash light emitted from the flash lamps 412 to the fixing side surface of the medium 1. Further, the opposing reflecting plate 413 is disposed at a location opposite to the flash lamps 412 and the reflecting mirror 411 with respect to the medium 1 and irradiates flash light emitted from the flash lamps 412 efficiently upon the medium 1.

The first fixing station 410 and the second fixing station 420 are disposed at positions different from each other along the transport path of the medium 1, and in the present embodiment, the second fixing station 420 is disposed on the downstream side of the first fixing station 410.

The first fixing station 410 fixes a toner image formed on the rear surface of the medium 1 by means of the first transfer process unit 250, and the second fixing station 420 fixes a toner image formed on the front surface of the medium 1 by means of the second transfer process unit 260.

The first fixing station 410 and the second fixing station 420 are surrounded by ducts 83. The ducts 83 are communicated with the blower 8 and collects smoke, odor and so forth composed of high molecular organic substances such as styrene, butadiene and phenol generated from the first fixing station 410 and the second fixing station 420.

The blower 8 includes a fan 81 and a filter 82 containing activated carbon or the like. Air in the ducts 83 is discharged by the fan 81 of the blower 8, and thereupon, the air which contains smoke and so forth is collected by the ducts 83 and is passed through the filter 82. The filter 82 attracts and removes the smoke, odor and so forth contained in the air. Consequently, clean air is discharged to the outside of the apparatus.

The flash fixing unit power supply 9 supplies power to the flash lamps 412 of the first fixing station 410 and the second fixing station 420.

Though not shown, in the present apparatus, a main power supply is provided in a first housing 1001 and supplies power to the first transfer process unit 250, the second transfer process unit 260, the transport system 700 and other required components.

Operation of various components of the present apparatus including the paper hopper 10, transport system 700, first transfer process unit 250, second transfer process unit 260, first fixing station 410, second fixing station 420, stacker 60, blower 8. flash fixing unit power supply 9 and so forth is controlled by the control apparatus not shown.

The control apparatus compares count values sent thereto from the developing units 219 with a toner hopper of the first transfer process unit 250 and the second transfer process unit 260 with a predetermined value recorded in advance and controls, when the count values exceed the predetermined value, so that a display member not shown may report to an operator that the filter 82 should be replaced, for example, by lighting an alarm lamp (not shown). Further, when replacement of the filter 82 is performed by the operator or some other person, the control apparatus resets the count values of the developer counters to zero.

The transport system 700 transports the medium 1 to successively pass the first transfer process unit 250, second transfer process unit 260, first fixing station 410 and second fixing station 420 in a section from the paper hopper 10 to the stacker 60 and includes a transport tractor 710, a guide section 75, guide rollers 76, a transfer guide roller 77, a first turn-around roller pair 40 and a second turn-around roller 51.

The transport tractor 710 is a transport apparatus for transporting the medium 1 and includes a plurality of (two in the present embodiment) tractor mechanisms 72 and 73. The tractor mechanisms 72 and 73 have a common construction to each other and both include an endless tractor belt 721 which has feed pins provided in a projecting manner at equal distances thereon and extends between and around a driving shaft 722 and a driven shaft 723 arranged in parallel to each other.

A driving belt 725 extends between and around the driving shaft 722 of the tractor mechanism 72 and the driving shaft 722 of the tractor mechanism 73, and a drive motor 724 is connected to the driving shaft 722 of the tractor mechanism 72.

The drive motor 724 is adapted to drive the driving shaft 722 to rotate at an arbitrary speed in an arbitrary direction. When the driving shaft 722 is driven to rotate by the drive motor 724, the driving shaft 722 of the tractor mechanism 72 and the driving shaft 722 of the tractor mechanism 73 are driven to rotate in synchronism with each other in the same direction to transport the medium 1 in any of a transporting direction for printing and a direction opposite to the transporting direction.

When the medium 1 is to be transported in the direction opposite to the transporting direction for printing, the transport tractor 710 can transport the medium 1 at a speed higher than the transporting speed for printing.

The transport tractor 710 includes a back tension roller 71 provided between the tractor mechanism 73 and the tractor mechanism 72, that is, on the upstream side of the tractor mechanism 72 disposed on the most downstream side, and serving as a medium tensioning member for exerting a tension in the direction opposite to the transporting direction for printing of the medium 1.

The back tension roller 71 includes a pair of tensioning rollers including a driving side tensioning roller 712 and a driven side tensioning roller 711.

A drive motor 714 (roller driving source) is connected to the driving side tensioning roller 712 through a one-way clutch 713 so that the driving side tensioning roller 712 is driven to rotate at an arbitrary speed in the transporting direction for printing of the medium 1 or the direction opposite to the transporting direction by the drive motor 714.

More particularly, when the medium 1 is to be transported in the transporting direction for printing, the drive motor 714 drives the driving side tensioning roller 712 to rotate so that the circumferential speed of the driving side tensioning roller 712 in the transporting direction for printing of the medium 1 may be lower than the transporting speed for printing of the medium 1.

The transporting speed for printing of the medium 1 must be equal to the transporting speeds of the tractor mechanisms 72 and 73, and to this end, the feed pins of tractor mechanisms 72 and 73 may always contact with leading side portions of the feed holes of the medium 1 in the transporting direction for printing. Consequently, no play appears between the feed holes of the medium 1 and the feed pins of the tractor mechanisms 72 and 73, and the transporting speed for printing of the medium 1 can be made equal to the transportation speeds of the tractor mechanisms 72 and 73 and can be stabilized.

Further, the circumferential speed of the driving side tensioning roller 712 is set lower so that the speed difference V1 between the circumferential speed of the driving side tensioning roller 712 and the transporting speed for printing of the medium 1 may satisfy $0<V1\leqq 10(\%)$. Where the speed difference V1 is set to such a range as just mentioned, the medium 1 can be transported well. It is to be noted that, if the speed difference V1 is set higher than 10%, then the feed holes of the medium 1 are damaged or broken.

The drive motor 714 drives, when the medium 1 is to be transported in the direction opposite to the transporting direction for printing, the driving side tensioning roller 712 to rotate so that the circumferential speed of the driving side tensioning roller 712 may be higher than the transporting speed for printing of the medium 1 in the direction opposite to the transporting direction for printing of the medium 1.

In particular, it is necessary to control the behavior of the medium 1 in the proximity of the first transfer process unit 250 and the second transfer process unit 260 positioned on the downstream sides of the tractor mechanisms 72 and 73 during transportation of the medium 1 to achieve stabilized transportation of the medium 1 and to allow stabilized transportation to be performed immediately when the medium 1 is to be transported in the transporting direction for printing after transportation of the medium 1 in the direction opposite to the transporting direction for printing is completed. To this end, the feed pins of the tractor mechanisms 72 and 73 are always contacted with leading portions of the feed holes of the medium 1 in the transporting direction for printing.

Consequently, no play is produced between the feed holes of the medium 1 and the feed pins of the tractor mechanisms 72 and 73. Accordingly, an inadvertent movement of the medium 1 in the proximity of the first transfer process unit 250 and the second transfer process unit 260 can be suppressed. Besides, since the feed pins of the tractor mechanisms 72 and 73 always contact with leading portions of the feed holes of the medium 1 in the transporting direction for printing, when the medium 1 is to be transported in the transporting direction for printing after completion of transportation of the medium 1 in the direction opposite to the transporting direction for printing, the feed holes of the medium 1 and the feed pins of the tractor mechanisms 72 and 73 are not displaced from each other and, even after transportation of the medium 1 in the direction opposite to the transporting direction for printing, the medium 1 can be transmitted immediately and stably.

Further, the circumferential speed of the driving side tensioning roller 712 is set higher so that the speed difference V1 between the circumferential speed of the driving side tensioning roller 712 and the transporting speed for printing of the medium 1 may satisfy $0<V1\leqq 10(\%)$. Where the speed difference V1 is set to such a range as just mentioned, the medium 1 can be transported well. It is to be noted that, if the speed difference V1 is set higher than 10%, then the feed holes of the medium 1 are damaged or broken.

The driven side tensioning roller 711 presses the medium 1 against the driving side tensioning roller 712 from above the medium 1 and is driven to rotate by the medium 1 being transported.

In particular, when the driving side tensioning roller 712 is driven to rotate in the direction opposite to the transporting direction for printing of the medium 1 by the drive motor 714 in a condition wherein the medium 1 is held by and between the driving side tensioning roller 712 and the driven side tensioning roller 711 of the back tension roller 71, the back tension roller 71 exerts a tension in the direction opposite to the transporting direction for printing to the medium 1.

The one-way clutch 713 is interposed between the driving side tensioning roller 712 and the drive motor 714 so that an excessive force may not be applied to the drive motor 714 even if, for example, when the medium 1 is transported at a high speed in the transporting direction for printing in order to perform replacement of the medium 1 or in a like case, the driving side tensioning roller 712 is rotated compulsorily in the transporting direction for printing by a frictional force exerted between the driving side tensioning roller 712 and the medium 1 or by some other force.

The first turn-around roller pair 40 is interposed between the second transfer process unit 260 and the first fixing station 410 and includes a pair of first turn-around rollers 41 and 42 which are located in an opposing relationship to each other with the medium 1 interposed therebetween and contact with and are driven to rotate by the medium 1 when the medium 1 is transported. The first turn-around roller 41 is mounted for contacting with the rear surface of the medium 1 while the first turn-around roller 42 is mounted for contacting with the front surface of the medium 1.

It is to be noted that the first turn-around rollers 41 and 42 have a length in the widthwise direction of the medium 1 which is set longer than the photosensitive drums 211 of the length of the first transfer process unit 250 and the second transfer process unit 260 or the second fixing station 420 in the widthwise direction of the medium 1.

Each of the first turn-around rollers 41 and 42 is formed from, for example, a member which has a low light transmittivity and has a low light reflection factor at the surface thereof, such as, for example, an aluminum roller painted in black, and its surface is treated with a fluorine contained resin such as a PFA. Each of the first turn-around rollers 41 and 42 is charged at the surface thereof with the same polarity as that of toner powder.

The medium 1 is wrapped over a predetermined angle over the first turn-around roller 42 of the first turn-around rollers 41 and 42 which compose the first turn-around roller pair 40 such that the angle defined between the transport path of the medium 1 in the second transfer process unit 260 and the transport path of the medium 1 in the second fixing station 420 may be a predetermined angle $\theta 1$ (preferably $\theta 1 \geqq 30$ degrees). Thus, the first turn-around roller 42 functions as a turn-around element for changing the transporting direction of the medium 1 between the second transfer process unit 260 and the first fixing station 410.

Further, the first turn-around roller pair 40 disposed between the second transfer process unit 260 and the first fixing station 410 functions as a light intercepting member (light intercepting roller) for preventing light leaking from the first fixing station 410 and the second fixing station 420 from arriving at the first transfer process unit 250 and the second transfer process unit 260.

Since the turn-around section is formed from the first turn-around roller pair 40 composed of the first turn-around rollers 41 and 42, the turn-around section can be implemented with a simple construction and allows the medium 1 to be transported without having a bad influence upon a toner image formed on the medium 1.

Further, since the first turn-around rollers 41 and 42 of the first turn-around roller pair 40 prevent light leaking from the first fixing station 410 and the second fixing station 420 from being irradiated upon the photosensitive drums 211 of the first transfer process unit 250 and the second transfer process unit 260, reduction of the lives of the photosensitive drums 211 caused by optical deterioration can be prevented and besides deterioration of the printing quality caused by a drop of the surface potentials of the photosensitive drums 211 can be prevented.

Further, since the first turn-around rollers 41 and 42 which compose the first turn-around roller pair 40 are longer than the length of the photosensitive drums 211 of the first transfer process unit 250 and the second transfer process unit 260 or the length of the second fixing station 420 in the widthwise dimension of the medium 1, they can prevent light leaking from the first fixing station 410 and the second fixing station 420 from being irradiated upon the photosensitive drum 211 of the first transfer process unit 250 or the second transfer process unit 260 through a medium non-passing location la (refer to FIGS. 3 and 5) of the transport path of the medium 1. Consequently, reduction of the lives of the photosensitive drums 211 by optical deterioration can be prevented and deterioration of the printing quality by a drop of the surface potentials of the photosensitive drums 211 can be prevented.

Further, since the first turn-around rollers 41 and 42 are each formed from an aluminum roller painted in black and processed by surface treatment with a fluorine contained resin such as a PFA, the transmittivity of light thereof is so low that interception of light can be achieved with certainty. Further, since each of the first turn-around rollers 41 and 42 has a low reflection factor of light at the surface thereof, irradiation of light upon the photosensitive drums 211 of the first transfer process unit 250 and the second transfer process unit 260 caused by random reflection from the surfaces of them of light leaking from the first fixing station 410 and the second fixing station 420 can be prevented. Further, since the first turn-around rollers 41 and 42 are processed by surface treatment with a fluorine contained resin such as a PFA, they exhibit a good releasing property of toner powder. Furthermore, since the surfaces of them are charged with the same polarity as that of toner powder, toner powder is not likely to stick to them, and consequently, a toner image is not disturbed by unnecessary toner powder.

Further, also since the angle provided by the first turn-around roller pair 40 between the transport path of the medium 1 in the second transfer process unit 260 and the transport path of the medium 1 in the second fixing station 420 is set larger than the predetermined angle $\theta 1$ (preferably $\theta 1 \geqq 30$ degrees), light leaking from the second fixing station 420 is prevented from arriving at the first transfer process unit 250 and the second transfer process unit 260.

Furthermore, since the first turn-around roller pair 40 functions as a light intercepting member (light intercepting roller) which prevents light leaking from the first fixing station 410 and the second fixing station 420 from arriving at the first transfer process unit 250 and the second transfer process unit 260, there is no need of providing a separate light intercepting member, and the number of parts which compose the apparatus can be reduced as much.

The second turn-around roller 51 is disposed between the first fixing station 410 and the second fixing station 420 such that it contacts with the surface (in the present embodiment, the rear surface) of the medium 1 to which a toner image is to be fixed by the first fixing station 410, and serves as a transporting direction changing roller which contacts with the medium 1 and rotates in the transporting direction of the medium 1.

The second turn-around roller 51 is constructed such that the medium 1 is wrapped over a predetermined angle therearound and functions as a transporting direction changing section which contacts with one of the surfaces of the medium 1 to change the transporting direction of the medium 1 between the first fixing station 410 and the second fixing station 420 so that the medium 1 is sent out to the second fixing station 420.

It is to be noted that the second turn-around roller 51 is formed such that the length thereof in the widthwise direction of the medium 1 may be greater than the length of the photosensitive drums 211 of the first transfer process unit 250 and the length of the second transfer process unit 260 or the second fixing station 420 in the widthwise direction of the medium 1. Further, the second turn-around roller 51 is formed from a member which has a low transmittivity of light and has a low reflection factor of light at the surface thereof.

Then, since the medium 1 is wrapped over a predetermined angle around the second turn-around roller 51, a frictional force exerted between the front surface of the medium 1 and the roller surface of the second turn-around roller 51 acts, upon transportation of the medium 1 by the transport tractor 710, as a reactive force to the medium 1 so that, upon transportation, the medium 1 can always be kept taut.

It is to be noted that, while, in the present embodiment, the second turn-around roller 51 contacts with the rear surface of the medium 1, a toner image on the rear surface of the medium 1 at the second turn-around roller 51 has already been fixed by the first fixing station 410 and is not disturbed by the contact with the second turn-around roller 51, and consequently, the printing quality of the medium 1 is not deteriorated.

Further, since the transporting direction of the medium 1 is changed by the second turn-around roller 51 so that the transporting direction of the medium 1 in the second fixing station 420 may be a substantially horizontal direction, the second fixing station 420 can be disposed at a low position, and consequently, the height of the transporting path of the medium 1 can be constructed low and the apparatus can be miniaturized.

Furthermore, since the second turn-around roller 51 changes the transporting direction of the medium 1, light leaking through the medium non-passing location la in the second fixing station 420 does not arrive at the photosensitive drums 211 of the first transfer process unit 250 and the second transfer process unit 260. Further, the second turn-around roller 51 prevents light leaking from the second fixing station 420 from propagating along the front surface of the medium 1 until it arrives at the second transfer process unit 260, and thus intercepts leaking light from the entire second fixing station 420. In this manner, the second turn-around roller 51 functions as a light intercepting member (light intercepting roller).

In particular, since the second turn-around roller 51 prevents light leaking from the second fixing station 420 from being irradiated upon the photosensitive drum 211 of the second transfer process unit 260, reduction of the life of the photosensitive drum 211 caused by optical deterioration of the photosensitive drum 211 can be prevented and besides deterioration of the printing quality by a drop of the surface potential of the photosensitive drum 211 can be prevented.

Further, since the dimension of the second turn-around roller 51 in the widthwise direction of the medium 1 is greater than the length of the photosensitive drums 211 of the first transfer process unit 250 and the second transfer process unit 260 or the length of the second fixing station 420 in the widthwise dimension of the medium 1, leaking light can be prevented from being irradiated upon the photosensitive drums 211 of the first transfer process unit 250 and the second transfer process unit 260 through the medium non-passing location 1*a* of the transport path of the medium 1. Consequently, reduction of the lives of the photosensitive drums 211 by optical deterioration of the photosensitive drums 211 can be prevented and besides deterioration of the printing quality by a drop of the surface potentials of the photosensitive drums 211 can be prevented.

Furthermore, since the second turn-around roller 51 is formed from a member which has a low transmittivity of light, interception of light can be achieved with certainty. Further, since the surface portion of the second turn-around roller 51 is formed from a member having a low reflection factor of light, arrival of light at the photosensitive drums 211 of the first transfer process unit 250 and the second transfer process unit 260 originating from light reflected at random from the surface portion of the second turn-around roller 51 can be prevented.

Furthermore, since the second turn-around roller 51 serves also as a light intercepting roller as a light intercepting member which intercepts light leaking from the second fixing station 420 to prevent the leaking light from arriving at the second transfer process unit 260, the number of parts which compose the apparatus can be reduced as much, and the production cost can be reduced as much.

Further, by the transport system 700, particularly by the first turn-around roller pair 40 and the second turn-around roller 51, the angle defined between the transport path of the medium 1 in the first fixing station 410 and the transport path of the medium 1 in the second fixing station 420 is set to a predetermined angle $\theta 2$ (preferably, for example, $\theta 2 \geqq 10$ degrees) (in the present embodiment, to approximately 90 degrees).

A light intercepting section 43 for intercepting light leaking from the first fixing station 410 is disposed between the second transfer process unit 260 and the first fixing station 410. A construction and operation of the light intercepting section 43 will be hereinafter described.

The guide rollers 76 are disposed at a plurality of locations along the transport path of the medium 1 in the present apparatus and cooperate with the guide section 75, which is a curved plate-like member, to guide the medium 1 so that it passes a predetermined path.

The guide rollers 76 guide the medium 1 so as to pass between the photosensitive drum 211 and the transfer station 212 in the first transfer process unit 250 and guide the medium 1 having passed the second fixing station 420 to the stacker 60.

The medium 1 is wrapped over predetermined angles around the guide rollers 76 so that a frictional force exerted between the front surface of the medium 1 and the surface of each of the guide rollers 76 may act as a reactive force upon the medium 1 upon transportation of the medium 1 by the transport tractor 710 so that the medium 1 may always be kept taut during transportation thereof.

The transfer guide roller 77 is disposed on the upstream side of the transfer station 212 of the second transfer process unit 260 along the transport path of the medium 1 on the rear surface side of the medium 1 and contacts with the rear surface of the medium 1 to guide the medium 1 to the second transfer process unit 260.

The surface of the transfer guide roller 77 is coated with a film of a fluorine contained resin or a like material. The film prevents abrasion of the transfer guide roller 77 by friction with the medium 1 and prevents sticking of non-fixed toner powder on the rear surface of the medium 1 to the transfer guide roller 77.

The first turn-around rollers 41 and 42 and the transfer guide roller 77 are charged with the same polarity as that of non-fixed toner powder on the medium 1. Consequently, when each of the first turn-around rollers 41 and 42 and the transfer guide roller 77 contacts with non-fixed toner powder on the medium 1, the non-fixed toner powder on the medium 1 does not stick to the first turn-around roller 41 or 42 or the transfer guide roller 77 and does not have a bad influence on a toner image formed on the medium 1.

Further, a cleaning blade not shown is mounted for contacting at a predetermined angle with each of the first turn-around rollers 41 and 42 and the transfer guide roller 77. When the first turn-around rollers 41 and 42 and the transfer guide roller 77 are individually rotated in directions (such directions are hereinafter referred to as printing transportation directions) following transportation of the medium 1 upon printing, the cleaning blades scrape off toner powder sticking to the surfaces of the first turn-around rollers 41 and 42 and the transfer guide roller 77.

It is to be noted that the first turn-around rollers 41 and 42 and the transfer guide roller 77 are permitted to rotate only in the respective printing transportation directions.

Further, each of the first turn-around rollers 41 and 42 and the transfer guide roller 77 includes a retracting apparatus not shown. When the medium 1 is to be mounted into the present apparatus, the first turn-around rollers 41 and 42 and the transfer guide roller 77 are retracted individually from the transport path of the medium 1 by the respective retracting apparatus so that they may not contact with the surfaces of the medium 1 which is transported at a high speed.

Consequently, when the medium 1 is transported at a high speed, the first turn-around rollers 41 and 42 and the transfer guide roller 77 do not suffer from unsymmetrical wear by friction with the medium 1. Accordingly, vibrations, an erroneous movement and so forth upon transportation of the medium 1 which are caused by such unsymmetrical wear of the rollers can be prevented and this provides a high degree of reliability to the present apparatus.

Further, the transport system 700 includes a transport roller not shown provided on the downstream side of the second fixing station 420 but on the upstream side of the stacker 60. The transport roller transports the medium 1 in synchronism with the transport tractor 710 described hereinabove.

The stacker 60 is a medium stacking section for stacking the medium 1 after printed and includes a swing guide 61 and a stacker section 62. The swing guide 61 is rocked to guide the medium 1 transported by the guide rollers 76 so that the medium 1 is successively folded along a line of perforations thereof and stacked on the stacker section 62.

The first transfer process unit 250, second transfer process unit 260, first fixing station 410, second fixing station 420 and transport system 700 described above are disposed in the first housing 1001 while the blower 8, stacker 60 and flash fixing unit power supply 9 are disposed in a second housing 1002.

In particular, in the present apparatus, the stacker 60 is disposed on the downstream side of the second fixing station 420 within a range of a transport path length within which data compensation is possible by the host computer which is a host apparatus which has requested printing. Since the transport path length of the medium 1 from the second fixing station 420 to the stacker 60 is short, when some trouble such as jamming of the medium 1 occurs, re-printing for a portion over which such trouble has occurred can be performed rapidly by the host computer. Consequently, the time required for a re-setting operation can be reduced and the reliability of the apparatus can be improved.

In the transport tractor 710, a medium trailing end detection section 74 for detecting a trailing end of the medium 1 is mounted on the upstream side of the tractor mechanism 73. The medium trailing end detection section 74 is formed, for example, from an optical sensor including a light emitting element and a light receiving element and is disposed such that the medium 1 may intercept light to be transmitted from the light emitting element to the light receiving element. Thus, when the medium 1 which intercepts light between the elements disappears, light from the light emitting element is detected by the light receiving element, and this is displayed on a display element or the like not shown to notify the operator that the trailing end of the medium 1 has been detected.

In order for double-sided printing to be performed for the medium 1 by the double-sided printing apparatus of the present embodiment having the construction described above, the operator will first install the medium 1 in position into the paper hopper 10 and fit the feed pins of the tractor belt 721 of the tractor mechanism 73 into the feed holes formed on the opposite side portions of the medium 1 to attach the medium 1 in position to the tractor belt 721.

Thereafter, printing data are set to the present apparatus under the control of the host computer, and double-sided printing is started.

First, the medium 1 is transported by the transport system 700, and in the first transfer process unit 250, the photosensitive drum 211 is driven to rotate in the direction of the arrow mark a by the driving apparatus not shown in synchronism with the transportation of the medium 1 by the transport system 700.

Further in the first transfer process unit 250, the surface of the photosensitive drum 211 is charged uniformly by the prechargers 215, and the surface of the photosensitive drum 211 is exposed to an image of light from the exposure LED 216 in response to an image signal to be printed thereby to form an electrostatic latent image thereon.

Then, the latent image is developed by the developing unit 219 with a toner hopper to form a toner image corresponding to the printing data on the surface of the photosensitive drum 211.

Further, at the position opposite to the contacting position of the medium 1 with the photosensitive drum 211 with respect to the medium 1, the transfer charger 212*a* charges the medium 1 with the polarity opposite to that of the toner power which forms the toner image so that the toner image on the photosensitive drum 211 may be attracted to the medium 1 to transfer the non-fixed toner image to the rear surface of the medium 1. After this transfer, the charge of the medium 1 is cancelled by the separation charger 212*b* so as to facilitate later separation of the photosensitive drum 211 and the medium 1 from each other.

On the other hand, from the surface of the photosensitive drum 211 from which the toner image has been transferred to the rear surface of the medium 1, remaining toner powder remaining on the surface is removed by the cleaning section 220. Thereafter, the surface of the photosensitive drum 211 is charged uniformly by the prechargers 215 again.

Then, the medium 1 is transported to the second transfer process unit 260 by the transport system 700. In the second transfer process unit 260, the non-fixed toner powder is transferred to the front surface of the medium 1 in a similar manner as in the first transfer process unit 250.

Then, the medium 1 to the opposite surfaces of which the non-fixed toner images have been transferred is transported by the transport system 700 and passes the first turn-around roller pair 40 and the light intercepting section 43. Then, the toner image which has been transferred to the rear surface of the medium 1 is fixed by the first fixing station 410.

The medium 1 is further transported by the transport system 700. Then, after the transporting direction of the medium 1 is changed by the second turn-around roller 51, now the toner image which has been transferred to the front surface of the medium 1 is fixed by the second fixing station 420.

Further, the medium 1 is transported by the transport system 700 under the guidance of the guide rollers 76 and is distributed, in the stacker 60, by the swing guide 61 so that it is folded back and forth alternately along the perforations. Consequently, the medium 1 is stacked in an alternately folded condition in the stacker section 62.

In this manner, with the double-sided printing apparatus according to the preferred embodiment of the present invention, since the medium 1 is transported in order through the first transfer process unit 250, second transfer process unit 260, first turn-around roller pair 40 and second fixing station 420 by the transport system 700 and the second transfer process unit 260 is disposed higher than the first transfer process unit 250 while the first fixing station 410 is disposed higher than the second transfer process unit 260, the first transfer process unit 250 and the second transfer process unit 260 can be formed with a common structure. Consequently, the cost for development and the cost for production can be reduced, and the installation area required for the apparatus can be reduced.

Further, since the second fixing station 420 is disposed on the downstream side of the first fixing station 410 and the second turn-around roller 51 is disposed between the first fixing station 410 and the second fixing station 420 such that the transport path of the medium 1 is changed by the second turn-around roller 51, the height of the transport path of the medium 1 can be made low. Consequently, the apparatus can be constructed in a reduced size and the operability of the operator can be augmented.

It is to be noted that, also where the second turn-around roller 51 is disposed on the downstream side of the first transfer process unit 250 and the second transfer process unit 260 such that the direction of the transport path of the medium 1 is changed by the second turn-around roller 51, the height of the transport path of the medium 1 can be made low, and consequently, the apparatus can be constructed in a reduced size and the operability of the operator can be augmented.

Further, since the first fixing station 410 and the second fixing station 420 are surrounded by the ducts 83 individually communicated with the blower 8 so that smoke, odor and so forth composed of high molecular organic substances such as styrene, butadiene and phenol generated from the first fixing station 410 and the second fixing station 420 are collected while a developer counter not shown is provided for each of the developing units 219 with a toner hopper of the first transfer process unit 250 and the second transfer process unit 260 such that, each time the first transfer process unit 250 and the second transfer process unit 260 perform printing, the developing units 219 with a toner hopper count up the developer counters and the count values of the developer counters are compared with a predetermined value recorded in advance by the control apparatus not shown, a timing at which the filter 82 should be replaced can be discriminated readily. Consequently, the maintenance is facilitated and the operability is improved.

Further, in the transport system 700, since the transport tractor 710 is composed of a plurality of (two in the present embodiment) tractor mechanisms 72 and 73 and the tractor mechanisms 72 and 73 are formed in a common construction to each other, the production cost of the transport tractor 710 can be reduced.

Further, since the driving belt 725 extends between and around the driving shaft 722 of the tractor mechanism 72 and the driving shaft 722 of the tractor mechanism 73 and the drive motor 724 is connected to the driving shaft 722 of the tractor mechanism 72, the tractor mechanisms 72 and 73 can be driven in synchronism with each other with certainty. Consequently, the medium 1 can be transported stably and the reliability of the apparatus can be augmented.

Furthermore, since the transport tractor 710 of the transport system 700 is disposed on the upstream side of the first transfer process unit 250 and composed of the tractor mechanisms 72 and 73, when the medium 1 is mounted in position into the present apparatus, the operator need not extend its hand to the first transfer process unit 250 disposed at a rather interior position of the apparatus as viewed from the paper hopper 10 side to mount the medium 1. Consequently, the operability in mounting the medium 1 can be augmented. Further, the medium 1 can be transported with certainty and the reliability of the apparatus can be augmented.

Further, since the tractor mechanisms 72 and 73 and the drive motor 724 are constructed such that the medium 1 can be transported in any of the transporting direction for printing and the direction opposite to the transporting direction, when some trouble such as jamming of the medium 1 occurs, as a re-setting operation, the medium 1 can be transported in the direction opposite to the transporting direction for printing to resume printing from a desired position of the medium 1 in order to print the location of the medium 1 at which the trouble has occurred.

Further, when the medium 1 is to be transported in the transporting direction for printing and in the direction opposite to the transporting direction, since the transport tractor 710 transports the medium 1 at a speed higher than the transporting speed for printing, when such a re-setting operation as described above is performed as a result of occurrence of some trouble such as occurrence of paper jamming, printing can be resumed rapidly.

Further, since the back tension roller 71 is composed of the driving side tensioning roller 712 and the driven side tensioning roller 711 which are a pair of tensioning rollers, the medium tensioning section can be implemented economically with a simple construction.

Furthermore, when the back tension roller 71 transports the medium 1 in the transporting direction for printing in a condition wherein the medium 1 is held between the driving side tensioning roller 712 and the driven side tensioning roller 711, the driving side tensioning roller 712 is driven to rotate by the drive motor 714 such that the circumferential speed of the driving side tensioning roller 712 may be lower than the transporting speed for printing of the medium 1 in the transporting direction for printing of the medium 1 thereby to generate a tension to the medium 1 in the opposite direction to the transporting direction for printing so that the medium 1 can always be kept taut. Consequently, printing of a high quality on the medium 1 can be preformed without slackening of the medium 1 in the first transfer process unit 250, the second transfer process unit 260 and so forth, and occurrence of a trouble such as jamming can be prevented and the reliability of the apparatus can be augmented.

Further, when the medium 1 is to be transported in the direction opposite to the transporting direction for printing, since the drive motor 714 can drive the driving side tensioning roller 712 to rotate such that the circumferential speed of the driving side tensioning roller 712 may be higher than the transporting speed for printing of the medium 1 in the direction opposite to the transporting direction for printing of the medium 1 to generate a tension to the medium 1 in the transporting direction for printing to always tension the medium 1, the medium 1 is not slackened in the transport path of the medium 1. Consequently, occurrence of a trouble such as jamming can be prevented, and the reliability of the apparatus can be augmented.

Further, since the driven side tensioning roller 711 is mounted for releasably contacting with the medium 1 and is contacted, when the medium 1 is to be transported in the transporting direction for printing, with the medium 1 whereas, when the medium 1 is to be transported in the direction opposite to the transporting direction for printing, the driven side tensioning roller 711 is brought out of contact with the medium 1, friction does not occur between the medium 1 and the driven side tensioning roller 711. Consequently, abrasion of the driven side tensioning roller 711 can be prevented.

Further, since waste toner powder collected by the cleaning section 220 is discharged by the waste toner screw 221 which is driven to rotate by the drive motor not shown and is collected into the waste toner collector (a toner cartridge 217 after used), waste toner powder collected in the first transfer process unit 250 and the second transfer process unit 260 can be recovered readily and the operability in maintenance operation can be augmented.

Furthermore, since a toner cartridge 217 after used is re-used as a waste toner collector, there is no need of developing/producing a waste toner collector for exclusive use. Consequently, the production cost can be reduced and besides the operation can be reduced.

Further, single-sided printing may be performed using the second transfer process unit 260, second fixing station 420 and transport system 700. This allows common use of parts between the double-sided printing apparatus and the single-sided printing apparatus, and the time and the cost for development/production can be reduced.

B. Details of the Light Intercepting Section

Figure 3:
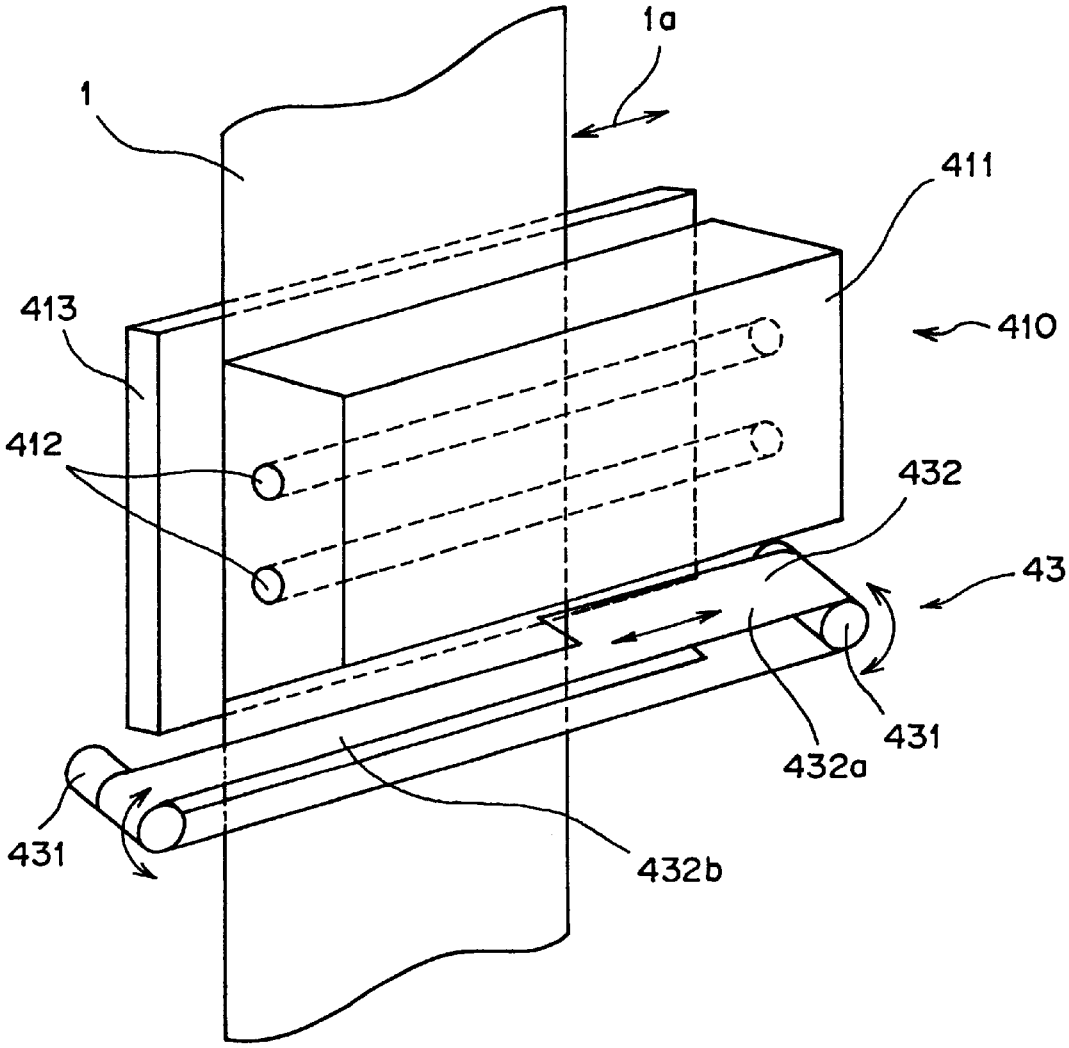
FIG. 3 is a perspective view schematically showing a construction of a light intercepting section of the double-sided printing apparatus shown in FIG. 1.
Figure 4:
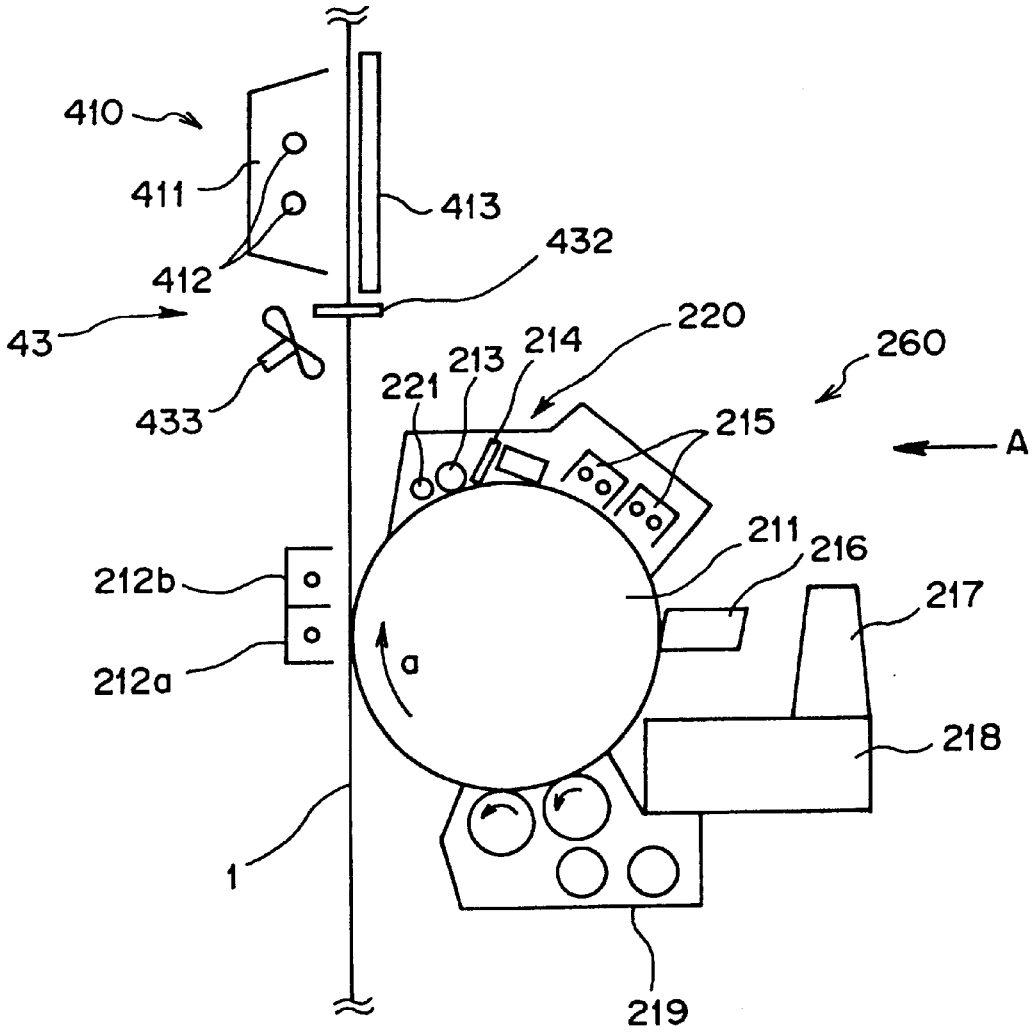
FIG. 4 is a side elevational view schematically showing a construction of elements around the light intercepting section of the double-sided printing apparatus shown in FIG. 1.
Figure 5:
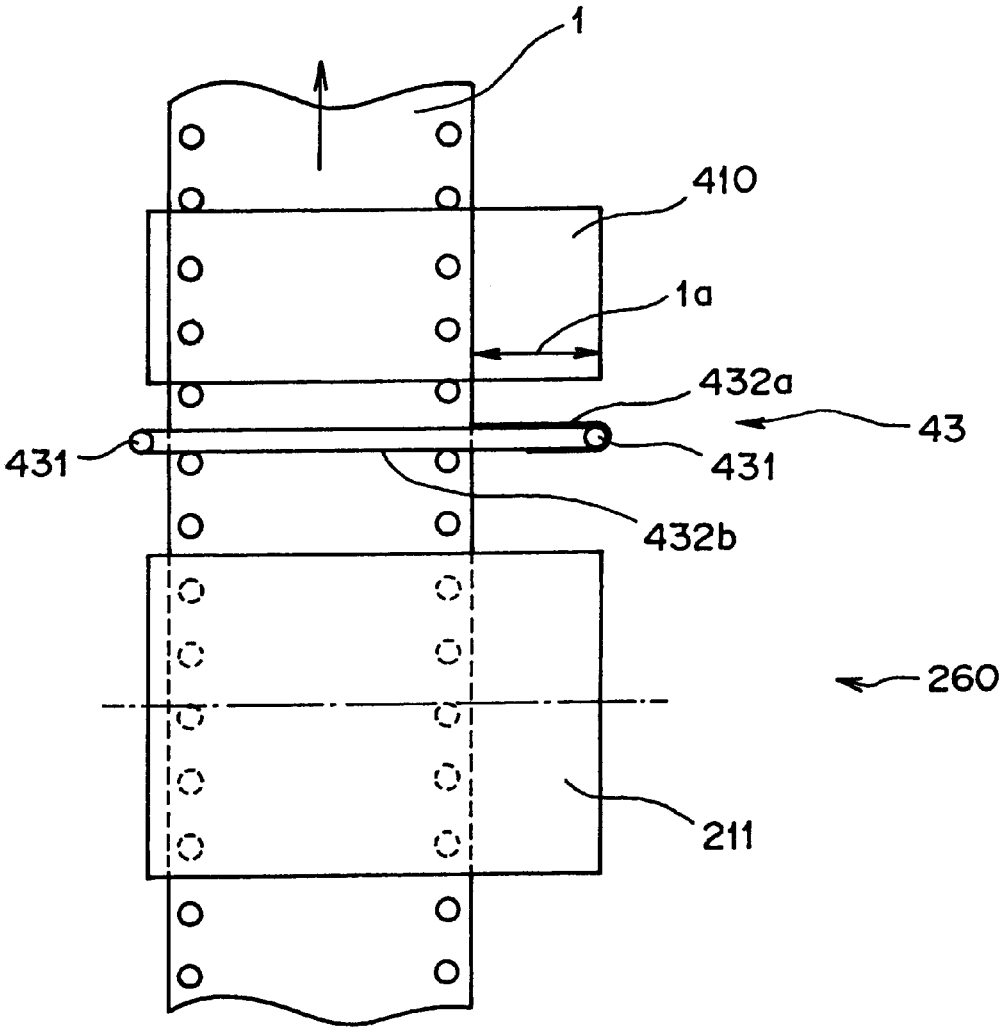
FIG. 5 is a view as viewed in a direction of an arrow mark A of FIG. 4.

The light intercepting section 43 is described with reference to FIGS. 3 to 5. FIG. 3 shows a construction of the light intercepting section 43 while FIG. 4 shows a construction of several components around the light intercepting section 43, and FIG. 5 is a view as viewed in the direction indicated by an arrow mark A. It is to be noted that, in FIGS. 3 to 5, some parts such as the first turn-around roller pair 40 are omitted for convenience of illustration.

The light intercepting section 43 is disposed between the second transfer process unit 260 and the first fixing station 410 as seen from FIGS. 4 and 5, and prevents irradiation of light from the first fixing station 410 upon the photosensitive drums 211 of the first transfer process unit 250 and the second transfer process unit 260 and particularly prevents irradiation of leaking light through the medium non-passing location 1*a*.

The light intercepting section 43 includes, as seen from FIG. 3, a pair of shafts 431, 431 disposed at opposing positions with the medium 1 interposed therebetween in the widthwise direction of the medium 1 and extending in parallel to each other and in a direction perpendicular to the plane in which the medium 1 is transported, and an endless belt-like member 432 extending between and around the shafts 431, 431 and having an wider portion 432*a* and a narrower portion 432*b*.

The belt-like member 432 is formed from a member of chloroprene rubber or a like material which has a low light transmittivity and has a low light transmission factor at the surface thereof.

With the light intercepting section 43, the belt-like member 432 is circulated between and around the shafts 431, 431 so that light to the medium non-passing location 1*a* is intercepted by the wider portion 432*a* in accordance with the width of the medium 1.

Accordingly, even if the kind of the medium 1 is changed or the like to change the widthwise dimension of the same and the widthwise dimension of the medium non-passing location 1*a* is changed thereby, by circulating the belt-like member 432 around the shafts 431, 431 to adjust the position of the belt-like member 432 so that the wider portion 432*a* of the belt-like member 432 may cover over the medium non-passing location 1*a*, irradiation of leaking light from the first fixing station 410 upon the photosensitive drums 211 of the first transfer process unit 250 and the second transfer process unit 260 through the medium non-passing location 1*a* of the transport path of the medium 1 can be prevented with certainty.

Furthermore, as seen from FIG. 4, a cooling mechanism 433 composed of a cooling fan and so forth for sending wind to the belt-like member 432 to cool the belt-like member 432 is disposed in the proximity of the belt-like member 432. It is to be noted that the cooling mechanism 433 is omitted for convenience of illustration in FIGS. 3 and 5.

Due to the construction described above, since the wider portion 432*a* of the belt-like member 432 is disposed at the medium non-passing location 1*a* in the proximity of the first fixing station 410, intense leaking light to be irradiated through the medium non-passing location la in the first fixing station 410 is prevented from being irradiated upon the photosensitive drums 211 of the second transfer process unit 260 and the first transfer process unit 250. Consequently, optical deterioration of the photosensitive drum 211 can be prevented, and besides, deterioration of the printing quality caused by a drop of the surface potential of each photosensitive drum 211 can be prevented.

Further, since the light intercepting section 43 is formed from the endless belt-like member 432 having the wider portion 432*a* and the narrower portion 432*b* and extending between and around the pair of shafts 431, 431 and the belt-like member 432 is circulated around the shafts 431, 431 so that light to pass through the medium non-passing location 1*a* is intercepted by the wider portion 432*a* in accordance with the width of the medium 1, the light intercepting function can be achieved readily whatever width the medium 1 has.

Furthermore, the belt-like member 432 can be produced readily by forming the wider portion 432*a* at a portion thereof, and the productivity can be augmented.

Moreover, since the belt-like member 432 is made of chloroprene rubber or the like which has a low light transmittivity, it can intercept leaking light from the first fixing station 410 and the second fixing station 420 with certainty. Further, since chloroprene rubber further has a low light reflection factor, irradiation of light caused by random reflection light from the surface of it upon the photosensitive drum 211 can be prevented. Consequently, optical deterioration of the photosensitive drum 211 can be prevented, and also deterioration of the printing quality caused by a drop of the surface potential of each photosensitive drum 211 can be prevented.

Furthermore, heating of the belt-like member 432 can be prevented also by providing the cooling mechanism 433 which cools the belt-like member 432, and thermal deterioration of the belt-like member 432 can be prevented.

It is to be noted that, while, in the embodiment described above, the belt-like member 432 is formed from a member (for example, of chloroprene rubber) having a low light transmittivity, it need not necessarily be formed from the specific member and can be carried out in various forms without departing from the spirit or scope of the present invention.

Further, the surface of the belt-like member 432 adjacent the first fixing station 410 may be formed form a member having a high light reflection factor. This augments the flash energy utilization efficiency of the first fixing station 410. Further, since heating of the belt-like member 432 can be prevented, thermal deterioration of the belt-like member 432 can be prevented.

C. Details of the Paper Jamming Processing Mechanism

Figure 6:
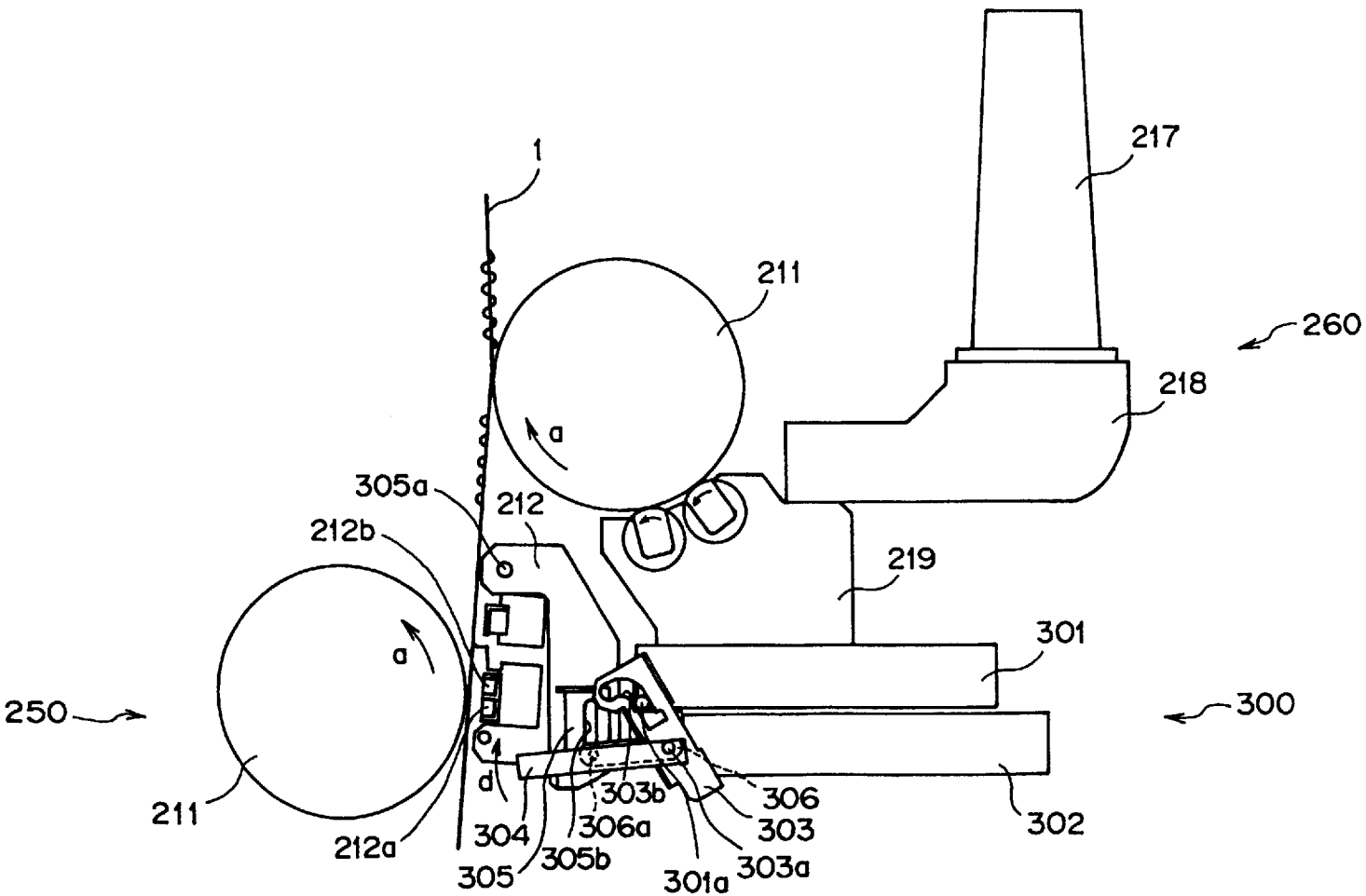
FIG. 6 is a side elevational view schematically showing a construction of a paper jamming processing section upon printing of the double-sided printing apparatus shown in FIG. 1.
Figure 7:
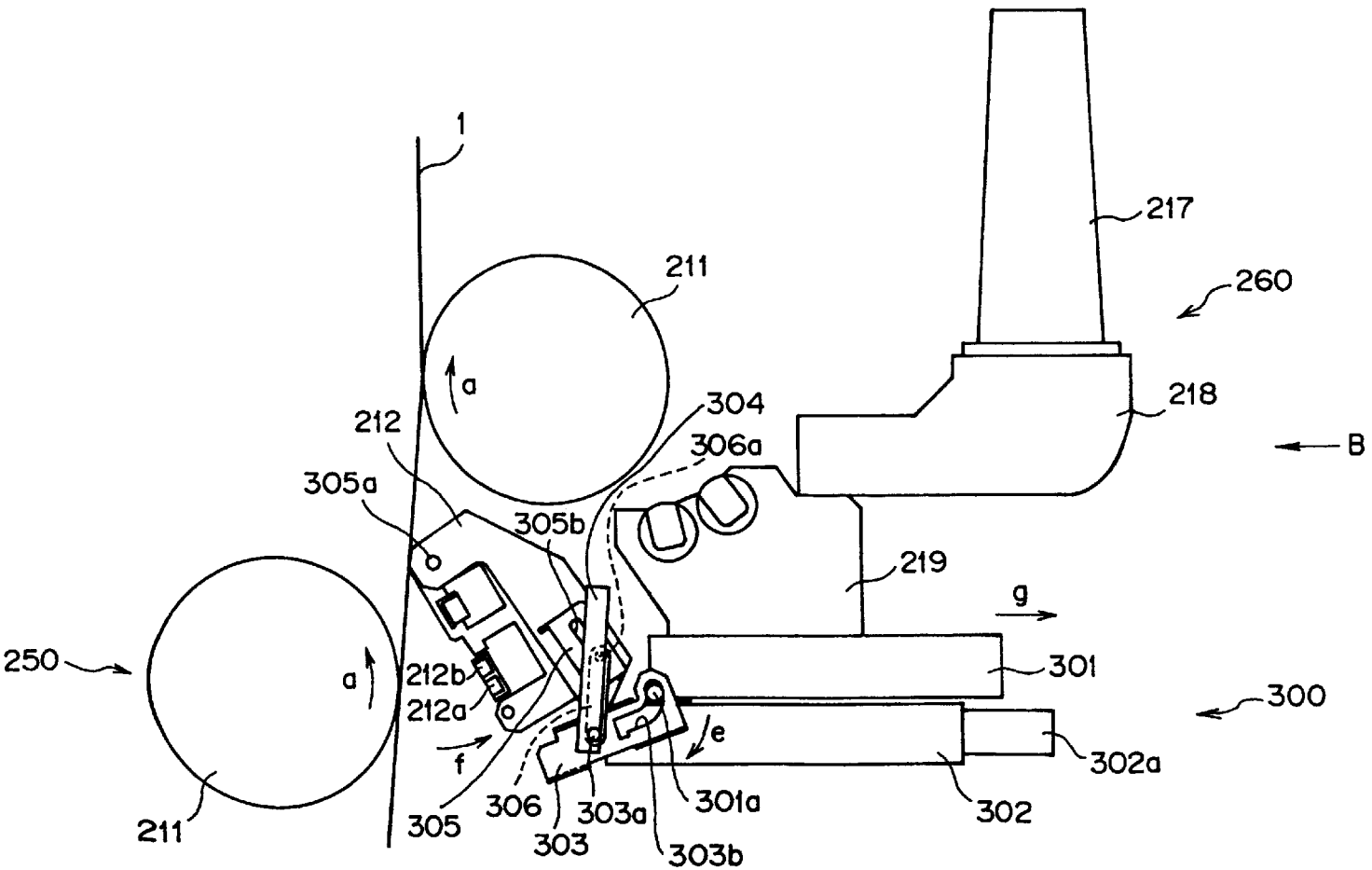
FIG. 7 is a similar view but showing a construction of the paper jamming processing section shown in FIG. 6 upon processing of jamming of the double-side printing apparatus shown in FIG. 1.
Figure 8:
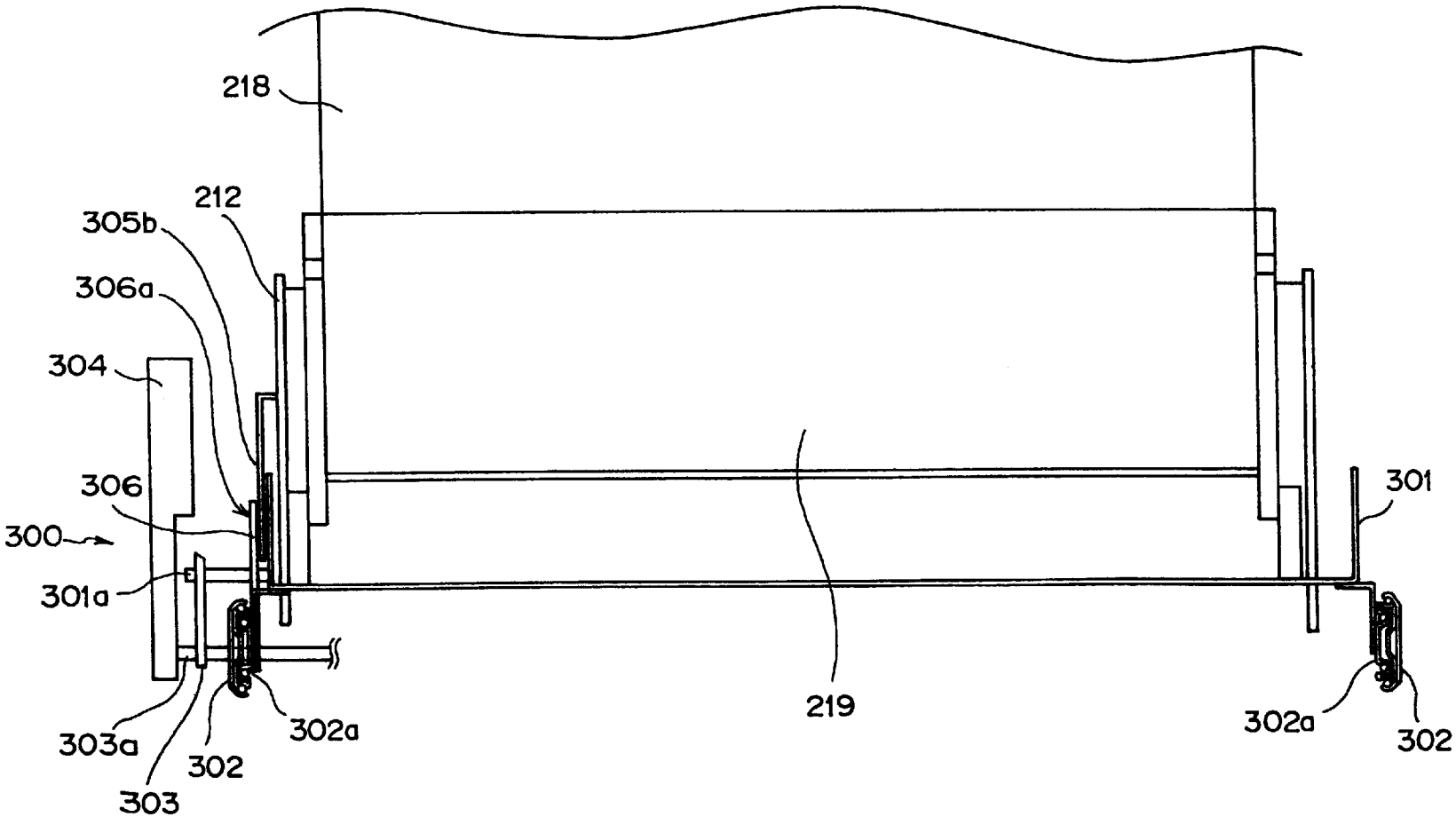
FIG. 8 is a view as viewed in a direction of an arrow mark B of FIG. 7.

FIGS. 6 to 8 show the paper jamming processing mechanism of the double-sided printing apparatus of the preferred embodiment of the present invention. More particularly, FIGS. 6 and 7 schematically show a construction of the paper jamming processing mechanism upon printing and upon jamming processing, respectively, and FIG. 8 is a view as viewed in the direction indicated by an arrow mark B in FIG. 7.

In the double-sided printing apparatus of the present embodiment, each of the first transfer process unit 250 and the second transfer process unit 260 includes a developing unit 219 with a toner hopper removably mounted thereon, and each of the developing units 219 with a toner hopper is retracted away from the medium 1 when it is removed from the corresponding photosensitive drum 211.

More particularly, the developing unit 219 with a toner hopper of the first transfer process unit 250 is removable leftwardly in FIG. 1 while the developing unit 219 with a toner hopper of the second transfer process unit 260 is removable rightwardly in FIG. 1.

Further, the developing unit 219 with a toner hopper of the second transfer process unit 260 is operatively associated with such a paper jamming processing mechanism 300 as shown in FIGS. 6 to 8.

The paper jamming processing mechanism 300 is a mechanism for removing the transfer station 212 of the first transfer process unit 250 from the photosensitive drum 211 in order to remove jamming of the first transfer process unit 250 with the medium 1 or the like.

As seen from FIGS. 6 to 8, the paper jamming processing mechanism 300 includes a developing unit receiving table 301, a slide rail 302, a developing unit receiving table link 303, an operation lever 304, a pair of slide plates 305 and a transfer pivoting link 306.

The transfer station 212 is supported for pivotal motion away from the medium 1 (in the direction indicated by an arrow mark f in FIG. 7) around a transfer station pivot shaft 305*a*. The pair of slide plates 305 are mounted on the opposite side faces of the transfer station 212, and guideways 305*b* are formed in the slide plates 305 substantially in parallel to the direction in which the transfer charger 212*a* and the separation charger 212*b* are juxtaposed.

The developing unit receiving table 301 is a platform on and to which the developing unit 219 with a toner hopper is placed and fixed, and is fixed to rail members 302*a* of the slide rail 302. A pair of developing unit receiving table pins 301*a* are provided on the opposite side portions of the developing unit receiving table 301 adjacent the medium 1.

The slide rail 302 extends in parallel to the developing unit receiving table 301 and holds the rail members 302*a* for sliding movement thereon in a horizontal direction. Accordingly, the developing unit receiving table 301 can be moved in parallel toward and away from the medium 1 (in the left and right directions in FIGS. 6 and 7) together with the developing unit 219 with a toner hopper by sliding movement of the rail members 302*a* on the slide rail 302.

The developing unit receiving table link 303 is a plate-like member in which a curved guideway 303*b* is formed. An end portion of a developing unit receiving table pin 301*a* of the developing unit receiving table 301 extends through the guideway 303*b*. Thus, the developing unit receiving table link 303 is movable under the guidance of the guideway 303*b* with the developing unit receiving table pin 301*a* received in the guideway 303*b*. Further, a pivot shaft 303*a* extending in parallel from the photosensitive-drum 211 from an end portion of the operation lever 304 extends through the developing unit receiving table link 303.

The transfer pivoting link 306 is disposed such that it connects the guideways 305*b* of the slide plates 305 mounted on the opposite side faces of the transfer station 212 to the pivot shaft 303*a*, and a slide shaft 306*a* is formed at an end portion of the transfer pivoting link 306 and is fitted for sliding movement in the guideway 305*b*. The other end portion of the transfer pivoting link 306 is fitted for pivotal motion around the pivot shaft 303*a*.

The operation lever 304 is fixed to an end portion of the pivot shaft 303*a* and extends substantially in parallel to the transfer pivoting link 306. The operation lever 304 is supported for pivotal motion in the direction indicated by an arrow mark d in FIG. 6 around an axis of the pivot shaft 303*a*.

In the paper jamming processing mechanism 300 having the construction described above, when jamming processing is to be performed, from a condition wherein the transfer station 212 is positioned in an opposing relationship to the photosensitive drum 211 of the first transfer process unit 250 with the medium 1 interposed therebetween and the developing unit 219 with a toner hopper is positioned adjacent the photosensitive drum 211 of the second transfer process unit 260 as seen in FIG. 6, the transfer station 212 is retracted from the photosensitive drum 211 of the first transfer process unit 250 and the developing unit 219 with a toner hopper is retracted from the photosensitive drum 211 of the second transfer process unit 260 as seen in FIG. 7. A process therefor is described below.

First, the operation lever 304 is pivoted in the direction indicated by the arrow mark d around the axis of the pivot shaft 303*a* from the condition shown in FIG. 6. This pivots the transfer pivoting link 306 in the direction of the arrow mark d around the axis of the pivot shaft 303*a*. Thereupon, the slide shaft 306*a* is moved upwardly under the guidance of the guideway 305*b* of the slide plate 305.

Upon the movement of the slide shaft 306*a* of the transfer pivoting link 306, the transfer station 212 is pivoted around the transfer station pivot shaft 305*a* and retracted from the photosensitive drum 211 of the first transfer process unit 250.

The transfer pivoting link 306 is further pivoted in the direction of the arrow mark d around the axis of the slide shaft 306*a* until it comes to a position of a substantially vertical posture in which the pivot shaft 303*a* is positioned most downwardly as seen in FIG. 7. Upon such pivotal motion of the transfer pivoting link 306, the developing unit receiving table link 303 is moved in the direction indicated by an arrow mark e in FIG. 7 around the slide shaft 306*a*. Upon such movement of the developing unit receiving table link 303, the developing unit receiving table pin 301*a* of the developing unit receiving table 301 is guided by the guide-way 303*b* formed in the developing unit receiving table link 303 so that it moves in a direction away from the medium 1 (in the direction indicated by an arrow mark g in FIG. 7) along the slide rail 302.

Then, as a result of this movement of the developing unit receiving table 301, the developing unit 219 with a toner hopper is retracted from the photosensitive drum 211 of the second transfer process unit 260.

On the other hand, in order to mount the developing unit 219 with a toner hopper in position onto the photosensitive drum 211, a process reverse to the process described above is taken.

According to the double-sided printing apparatus of the present embodiment which includes such a paper jamming processing mechanism 300 as described above, since the first transfer process unit 250 and the second transfer process unit 260 include the developing units 219 with a toner hopper removably mounted thereon and each of the developing units 219 with a toner hopper is moved away from the medium 1 when it is to be retracted, when paper jamming or the like occurs, a maintenance space around each of the photosensitive drums 211 can be assured. Consequently, the operation efficiency in a maintenance operation and so forth can be augmented.

Further, since the developing unit 219 with a toner hopper of the first transfer process unit 250 is operatively associated with the paper jamming processing mechanism 300, the developing unit 219 with a toner hopper can be retracted readily from the photosensitive drum 211 of the second transfer process unit 260 simultaneously when the transfer station 212 is retracted from the photosensitive drum 211 of the first transfer process unit 250. Consequently, when paper jamming or the like occurs, a maintenance space around each of the photosensitive drums 211 can be assured, and the operation efficiency in a maintenance operation and so forth can be augmented.

D. Others

While, in the embodiment described above, light leaking from the first fixing station 410 and the second fixing station 420 is intercepted by the light intercepting section 43 and the first turn-around roller pair 40, the countermeasure for such leaking light interception is not limited to them and can be carried out in various forms without departing from the spirit or scope of the present invention.

For example, a light intercepting roller which serves also as a transfer guide roller of the second transfer process unit 260 may be interposed between the first transfer process unit 250 and the second transfer process unit 260. Where the light intercepting roller is provided, the number of components of the apparatus can be reduced as much, and the production cost of the apparatus can be reduced as much.

Meanwhile, if a light intercepting member is disposed at a position adjacent the front surface of the medium 1 on the upstream side of the second fixing station 420 but on the downstream side of the first fixing station 410, it can prevent light leaking from the second fixing station 420, particularly from the downstream side of the second fixing station 420, from being reflected irregularly in the apparatus and being irradiated upon the photosensitive drums 211 of the first transfer process unit 250 and the second transfer process unit 260.

Further, separate light intercepting members such as light intercepting rollers may be disposed on the front surface side and the rear surface side of the medium 1. For example, a first light intercepting roller may be disposed adjacent the first transfer process unit 250 between the first transfer process unit 250 and the second transfer process unit 260 while a second light intercepting roller is disposed between the first fixing station 410 and the second fixing station 420. In this instance, light leaking from the first fixing station 410 and the second fixing station 420 and intense leaking light irradiated through the medium non-passing location la are prevented from being irradiated upon the photosensitive drums 211 of the second transfer process unit 260 and the first transfer process unit 250. Consequently, optical deterioration of the photosensitive drums 211 can be prevented and deterioration of the printing quality caused by a drop of the surface potential of each photosensitive drum 211 can be prevented.

Figure 9:
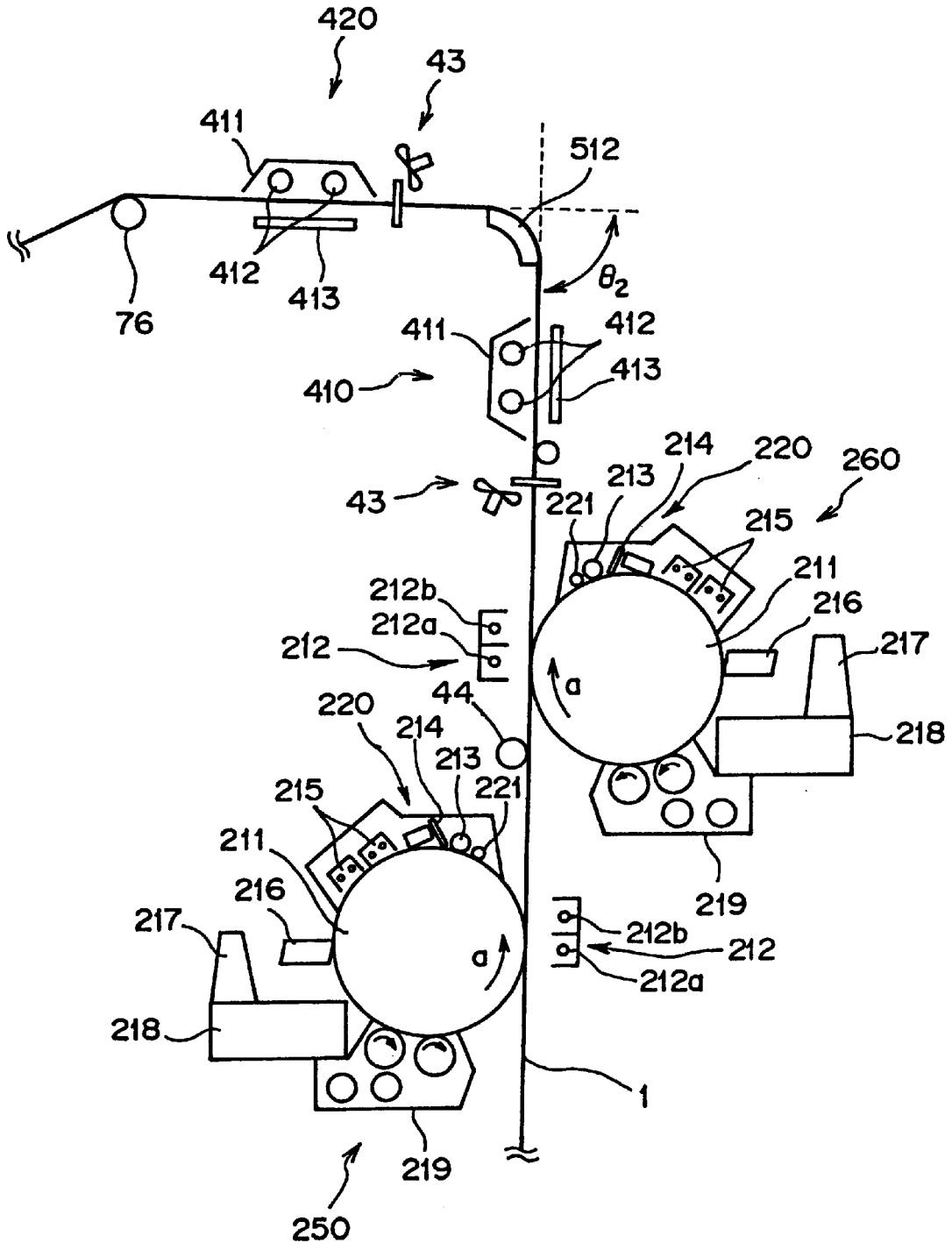
FIG. 9 is a side elevational view showing part of a transport system of a modification to the double-sided printing apparatus shown in FIG. 1.
Figure 10:
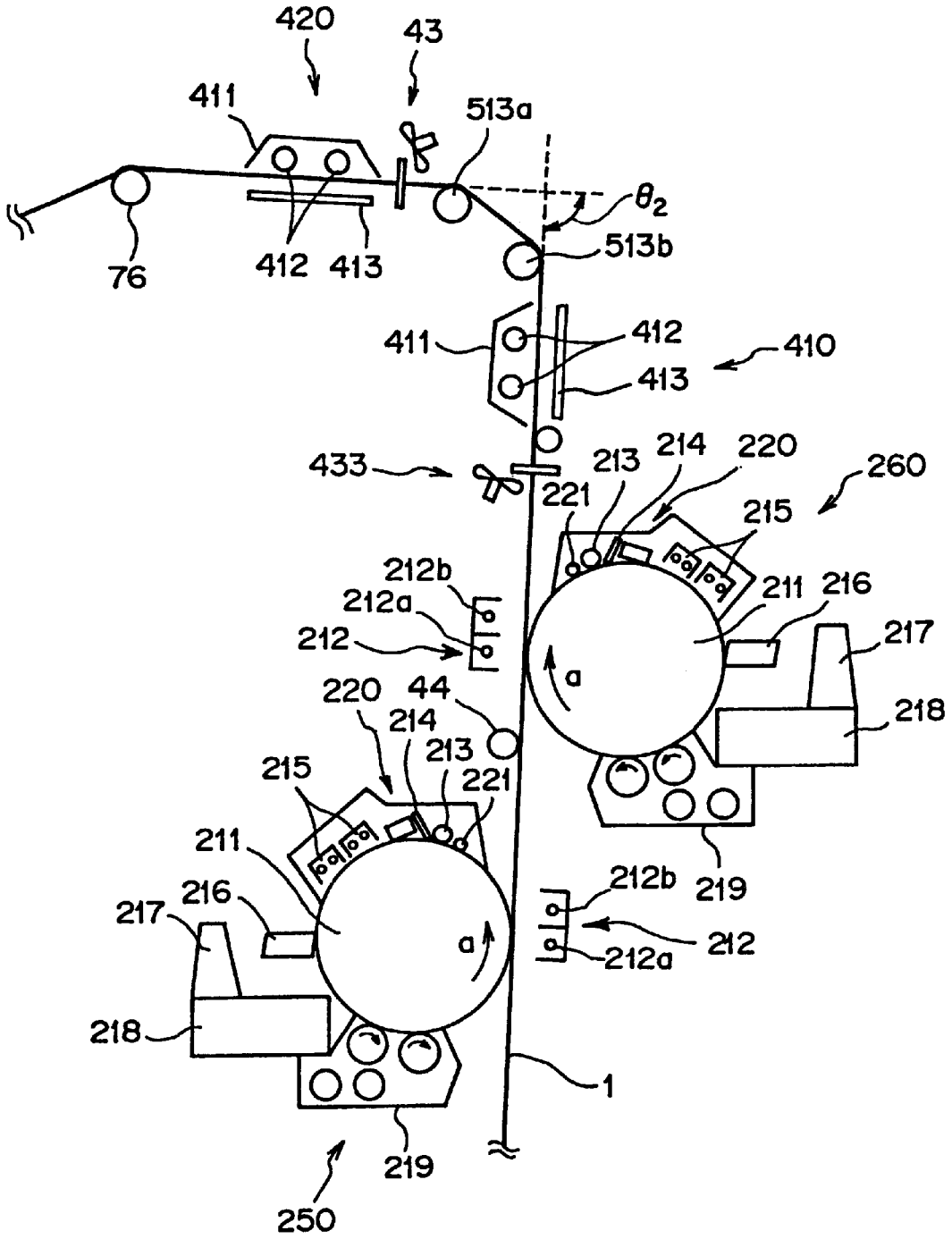
FIG. 10 is a similar view but showing part of a transport system of another modification to the double-sided printing apparatus shown in FIG. 1.

FIGS. 9 and 10 show modifications to the double-sided printing apparatus of the preferred embodiment of the present invention described above and each shows part of a transport system of the modified double-sided printing apparatus. It is to be noted that, in FIGS. 9 and 10, some parts such as the first turn-around roller pair 40 and so forth described above are omitted for convenience of illustration.

Referring first to FIG. 9, in the modified double-sided printing apparatus shown, a roll-shaped light intercepting roller 44 is disposed adjacent the rear surface of the medium 1 between the first transfer process unit 250 and the second transfer process unit 260. The light intercepting roller 44 contacts with and is driven to rotate by the rear surface of the medium 1 when the medium 1 is transported and has a length in the widthwise direction of the medium 1 greater than the length of the photosensitive drums 211 of the first transfer process unit 250 and the second transfer process unit 260 or the length of the second fixing station 420 in the widthwise direction of the medium 1. Further, the light intercepting roller 44 is formed from a member which has a low light transmittivity and has a low light reflection factor at the surface thereof, such as, for example, an aluminum roller painted in black and surface treated with a fluorine contained resin such as a PFA. Further, the light intercepting roller 44 is charged at the surface thereof with the same polarity as that of toner powder.

A turn-around guide 512 formed from a plate-like member having a moderate convex curved surface is disposed between the first fixing station 410 and the second fixing station 420 for contacting with the rear face of the medium 1.

Further, by the turn-around guide 512, the transport path of the medium 1 is set such that the angle defined by the transport path of the medium 1 in the second transfer process unit 260 and the transport path of the medium 1 in the second fixing station 420 is equal to or greater than a predetermined angle $\theta 2$ (for example, preferably $\theta 2 \geqq 10$ degrees) (in the present embodiment, approximately 90 degrees).

Further, a light intercepting section 43 is disposed at each of a position on the upstream of the second fixing station 420 but on the downstream of the turn-around guide 512 and another position on the upstream of the first fixing station 410 but on the downstream of the second transfer process unit 260.

In this manner, according to the double-sided printing apparatus according to the modification shown in FIG. 9, since the transporting direction of the medium 1 is changed by an angle greater than the predetermined angle $\theta 2$ by the turn-around guide 512, light leaking from the second fixing station 420 is not directly irradiated upon the photosensitive drums 211 of the first transfer process unit 250 and the second transfer process unit 260. Consequently, optical deterioration of the photosensitive drum 211 can be prevented, and deterioration of the printing quality caused by a drop of the surface potentials of the photosensitive drums 211 can be prevented.

Further, since the light intercepting section 43 disposed on the upstream side of the first fixing station 410 prevents irradiation of leaking light from the first fixing station 410 and intense leading light irradiated through the medium non-passing location 1*a* (refer to FIG. 5) and the light intercepting section 43 disposed on the upstream of the second fixing station 420 prevents irradiation of leaking light from the second fixing station 420 and intense leaking light irradiated through the medium non-passing location 1*a* (refer to FIG. 5) individually upon the photosensitive drums 211 of the second transfer process unit 260 and the first transfer process unit 250. Consequently, optical deterioration of the photosensitive drums 211 can be prevented, and deterioration of the printing quality caused by a drop of the surface potentials of the photosensitive drums 211 can be prevented.

Meanwhile, in the modified double-sided printing apparatus shown in FIG. 10, a plurality of (two in FIG. 10) second turn-around rollers 513*a* and 513*b* are disposed in place of the turn-around guide 512 of the modified double-sided printing apparatus shown in FIG. 9.

In particular, a plurality of (two in FIG. 10) second turn-around rollers 513*a* and 513*b* are disposed between the first fixing station 410 and the second fixing station 420 for contacting with the medium 1. The second turn-around rollers 513*a* and 513*b* have a construction similar to that of the second turn-around roller 515 described hereinabove.

Then, by the second turn-around rollers 513*a* and 513*b*, the transport path of the medium 1 is set such that the angle between the transport path of the medium 1 in the second transfer process unit 260 and the transport path of the medium 1 in the second fixing station 420 is equal to or greater than a predetermined angle θ2 (for example, preferably $\theta 2 \geqq 10$ degrees) (in the present modification, approximately 90 degrees).

In this manner, also with the modified double-sided printing apparatus shown in FIG. 10, since the transporting direction of the medium 1 is changed by the predetermined angle θ2 or more by the second turn-around rollers 513*a* and 513*b*, light leaking from the second fixing station 420 is not directly irradiated upon the photosensitive drums 211 of the first transfer process unit 250 and the second transfer process unit 260. Consequently, optical deterioration of the photosensitive drums 211 can be prevented, and deterioration of the printing quality caused by a drop of the surface potentials of the photosensitive drums 211 can be prevented.

Figure 11:
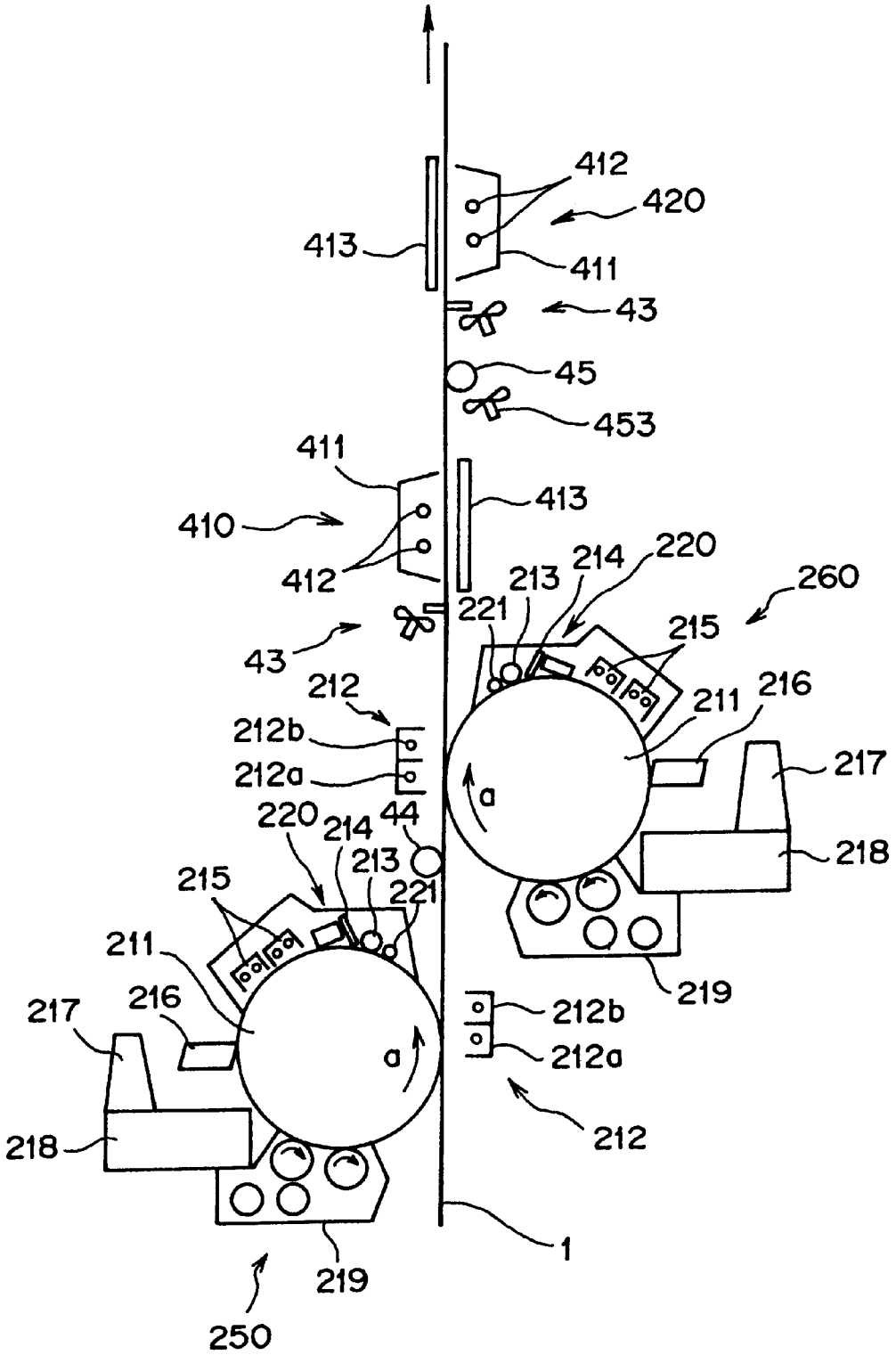
FIG. 11 is a side elevational view illustrating another light intercepting technique for intercepting light leaking from fixing units of the double-sided printing apparatus shown in FIG. 1.

FIG. 11 shows another countermeasure for intercepting light leaking from fixing units in a double-sided printing apparatus and shows part of a transport system of the double-sided printing apparatus. It is to be noted that the first turn-around roller pair 40 and so forth described hereinabove are not shown for convenience of illustration.

In the double-sided printing apparatus shown in FIG. 11, the first transfer process unit 250 electrophotographically transfers a toner image to the rear surface of the medium 1 under the control of the control apparatus not shown. Meanwhile, the second transfer process unit 260 is disposed above the first transfer process unit 250 and has a construction similar to that of the first transfer process unit 250. The second transfer process unit 260 is disposed on the opposite side of the first transfer process unit 250 with respect to the medium 1 and in a symmetrical relationship with the first transfer process unit 250 with respect to a vertical plane such that it contacts with the front surface of the medium 1 to form a toner image on the front surface of the medium 1.

Further, in the double-sided printing apparatus shown in FIG. 11, the first fixing station 410 is disposed above the second transfer process unit 260 and fixes a toner image formed on the rear surface of the medium 1 by means of the first transfer process unit 250 thereof. Meanwhile, the second fixing station 420 is disposed above the first fixing station 410 and fixed a toner image formed on the front surface of the medium 1 by means of the second transfer process unit 260 thereof.

Furthermore, the second turn-around roller 51 described hereinabove is not disposed between the first fixing station 410 and the second fixing station 420, and the second fixing station 420 is disposed above the first fixing station 410 without changing the transporting direction of the medium 1 between the first fixing station 410 and the second fixing station 420.

Moreover, a light intercepting roller 44 which is a roller-shaped light intercepting member is disposed on the rear surface side of the medium 1 between the first transfer process unit 250 and the second transfer process unit 260.

Further, the light intercepting roller 44 is formed from a member which has a low light transmittivity and has a low light reflection factor at the surface thereof, such as, for example, an aluminum roller painted in black and surface treated with a fluorine contained resin such as a PFA. Further, the light intercepting roller 44 is charged at the surface thereof with the same polarity as that of toner powder.

A cooling mechanism 453 formed from a cooling fan or the like is disposed in the proximity of the light intercepting roller 44 for sending wind to the light intercepting roller 44 to cool the light intercepting roller 44.

Further, a light intercepting section 43 is disposed at each of a position adjacent the first fixing station 410 with respect to the medium 1 on the downstream side of the second transfer process unit 260 but on the upstream side of the first fixing station 410 and another position adjacent the second fixing station 420 with respect to the medium 1 on the downstream side of the first fixing station 410 but on the upstream side of the second a fixing station 420. The light intercepting sections 43 prevent light leaking from the first fixing station 410 and the second fixing station 420 from being irradiated upon the photosensitive drums 211 of the first transfer process unit 250 and the second transfer process unit 260.

Further, a light intercepting roller 45 which is a roller-shaped light intercepting member is disposed adjacent the front surface of the medium 1 between the first fixing station 410 and the second fixing station 420. The light intercepting roller 45 contacts with and is driven to rotate by the rear surface of the medium 1 when the medium 1 is transported and has a length in the widthwise direction of the medium 1 greater than the length of the photosensitive drums 211 of the first transfer process unit 250 and the second transfer process unit 260 or the length of the second fixing station 420 in the widthwise direction of the medium 1.

Further, the light intercepting roller 45 is formed from a member which has a low light transmittivity and has a low light reflection factor at the surface thereof, such as, for example, an aluminum roller painted in black and surface treated with a fluorine contained resin such as a PFA. Further, the light intercepting roller 45 is charged at the surface thereof with the same polarity as that of toner powder.

In the double-sided printing apparatus having such a construction as described above with reference to FIG. 11, light leaking from the first fixing station 410 is intercepted by the light intercepting section 43 and the light intercepting roller 44 and is not irradiated upon the photosensitive drum 211 of the first transfer process unit 250. Consequently, optical deterioration of the photosensitive drum 211 of the first transfer process unit 250 can be prevented, and deterioration of the printing quality caused by a drop of the surface potentials of the photosensitive drums 211 can be prevented.

It is to be noted that, since the light intercepting members are formed from the light intercepting rollers 44 and 45 which are rollers, they can be implemented with a simple construction.

Further, light leaking from the second fixing station 420 is intercepted by the light intercepting section 43 and the light intercepting roller 45 and is not irradiated upon the photosensitive drum 211 of the second transfer process unit 260. Consequently, optical deterioration of the photosensitive drum 211 of the second transfer process unit 260 can be prevented, and deterioration of the printing quality caused by a drop of the surface potentials of the photosensitive drums 211 can be prevented.

Furthermore, since the light intercepting roller 45 is disposed in the proximity of the second fixing station 420 on the downstream side of the first fixing station 410, leaking light from the second fixing station 420 can be intercepted with certainty, and consequently, the leaking light from the second fixing station 420 is not reflected irregularly in the apparatus and is not irradiated upon the photosensitive drums 211 of the first transfer process unit 250 and the second transfer process unit 260. Consequently, optical deterioration of the photosensitive drums 211 can be prevented, and deterioration of the printing quality caused by a drop of the surface potentials of the photosensitive drums 211 can be prevented.

Furthermore, while the second transfer process unit 260 and the first fixing station 410 are disposed at positions comparatively near to each other with the medium 1 interposed therebetween, since light leaking from the first fixing station 410 is intercepted by the medium 1, the leaking light of the first fixing station 410 is not irradiated upon the photosensitive drum 211 of the second transfer process unit 260. Consequently, optical deterioration of the photosensitive drums 211 can be prevented, and deterioration of the printing quality caused by a drop of the surface potentials of the photosensitive drums 211 can be prevented.

Furthermore, since the first transfer process unit 250 and the second fixing station 420 are comparatively far from each other, before light leaking from the second fixing station 420 arrives at the first transfer process unit 250, the intensity of the light becomes weak. Further, the second transfer process unit 260 and the first fixing station 410 intercept light leaking from the second fixing station 420. Consequently, optical deterioration of the photosensitive drum 211 of the first transfer process unit 250 can be prevented, and deterioration of the printing quality caused by a drop of the surface potentials of the photosensitive drum 211 can be prevented.

Further, since the light intercepting rollers 44 and 45 have lengths in the widthwise direction of the medium 1 greater than the length of the photosensitive drums 211 of the first transfer process unit 250 and the second transfer process unit 260 or the length of the second fixing station 420 in the widthwise direction of the medium 1 and each of the light intercepting members 43 can intercept leaking light through the medium non-passing location 1*a*, irradiation of leading light upon the surfaces of the photosensitive drums 211 over the overall areas of them can be prevented. Consequently, optical deterioration of the photosensitive drums 211 can be prevented, and deterioration of the printing quality caused by a drop of the surface potentials of the photosensitive drums 211 can be prevented.

Further, each of the light intercepting rollers 44 and 45 is formed from an aluminum roller painted in black and surface treated with a fluorine contained resin such as a PFA and the belt-like member 432 (refer to FIG. 3) of each of the light intercepting members 43 is made of chloroprene rubber or the like which has a low light transmittivity, leaking light from the fixing stations can be prevented with certainty.

Furthermore, since the light intercepting roller 44 is cooled by the cooling mechanism 453 and the belt-like members 432 of the light intercepting members 43 are cooled by the cooling mechanisms 433, thermal deterioration of the fluorine contained resin used surface treatment of and formed on the surface of the light intercepting roller 44 can be prevented, and a high releasing performance of toner power can be maintained for a long period of time.

Further, since the light intercepting members 43 are disposed at a position on the downstream side of the first fixing station 410 and another position on the downstream side of the second fixing station 420 such that leaking light through the medium non-passing locations la in the first fixing station 410 and the second fixing station 420, optical deterioration of the photosensitive drums 211 by leaking light through the medium non-passing locations 1*a* can be prevented, and deterioration of the printing quality caused by a drop of the surface potentials of the photosensitive drums 211 can be prevented.

The present invention is not limited to the embodiment specifically described above but can be carried out in various forms without departing from the spirit or scope of the present invention.

It is to be noted that, while, in the embodiment and modifications described above, the transport tractor 710 includes the two tractor mechanisms 72 and 73 and the driving belt 725 extends between and around the driving shaft 722 of the tractor mechanism 72 and the driving shaft 722 of the tractor mechanism 73 and besides the drive motor 724 is connected to the driving shaft 722 of the tractor mechanism 72 to drive the driven shafts 723 to rotate, the construction of the transport tractor 710 is not limited to this specific one and can be carried out in various forms without departing from the spirit and scope of the present invention.

Figure 12:
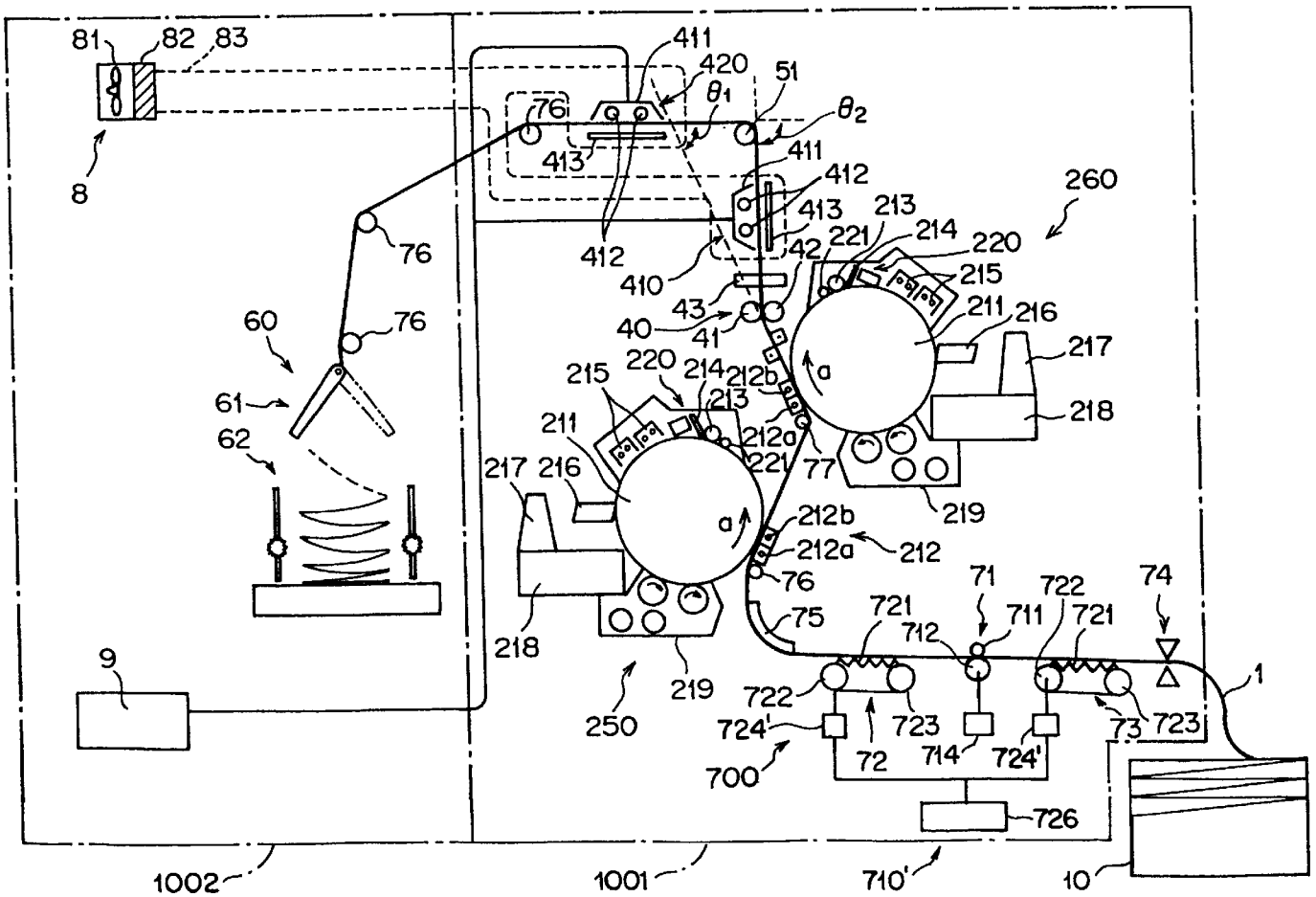
FIG. 12 is a schematic side elevational view showing a further modification to the double-sided printing apparatus shown in FIG. 1.

For example, FIG. 12 shows a still further modification to the double-sided printing apparatus of the preferred embodiment of the present invention. Referring to FIG. 12, in the modified double-sided printing apparatus shown, a transport tractor 710' is composed of a pair of tractor mechanisms 72 and 73 having a common construction. A pair of drive motors 724', 724' independent of each other are individually connected to driving shafts 722 of the tractor mechanisms 72 and 73 and are driven in synchronism with each other by a control apparatus 726. In the present modified double-sided printing apparatus, the tractor mechanisms 72 and 73 can be operated in synchronism with each other and transportation of the medium 1 can be performed stably by the transport system 700.

It is to be noted that, to the driving side tensioning roller 712 shown in FIG. 12, the drive motor 714 is connected without intervention of the one-way clutch 713.

Further, in the present modified double-sided printing apparatus, single-sided printing may be performed using the second transfer process unit 260, second fixing station 420, transport system 700 and so forth. This allows common use of parts such as the second transfer process unit 260, second fixing station 420 and transport system 700 between the double-sided printing apparatus and the single-sided printing apparatus, and thus allows reduction of the development/production costs.

It is to be noted that the driven side tensioning roller 711 is mounted for movement into and out of contact with the medium 1, and when the medium 1 is to be transported in the transporting direction for printing, the driven side tensioning roller 711 is contacted with the medium 1, but when the medium 1 is to be transported in the direction opposite to the transporting direction for printing, the driven side tensioning roller 711 is brought out of contact with the medium 1.

Also it is to be noted that, while, in the embodiment described above, each of the first turn-around rollers 41 and 42 and the transfer guide roller 77 includes a retracting apparatus not shown and is retracted, when the medium 1 is to be transported at a high speed, from the transport path of the medium 1, the constructions of the first turn-around rollers 41 and 42 and the transfer guide roller 77 are not limited to this specific one, and each of them may continue to always rotate in the transporting direction for printing of the medium 1 without including such a retracting apparatus as described above.

The present invention is not limited to the embodiment specifically described above, and variations and modifications can be made without departing from the scope of the present invention.

What is claimed is:

1. A double-sided printing apparatus for printing on a front surface and a rear surface of a medium, comprising:

a first image forming process unit for forming a toner image on the first surface of the medium which is either one of the front surface or the rear surface of the medium;

a second image forming process unit disposed above said first image forming process unit for forming a toner image on the second surface of the medium that is the other side of the first surface;

a first fixing station disposed above said second image forming process unit for fixing the toner image formed on one of said first surface or said second surfaces of the medium;

a second fixing station disposed at a position different from that of said first fixing station for fixing the toner image formed on the other surface of the medium, which is not fixed by said first fixing station;

a transport system for transporting the medium successively to said first image forming process unit, second image forming process unit, first fixing station and second fixing station; and a medium stacking section for stacking the medium after printed;

said first image forming process unit, second image forming process unit, first fixing station, second fixing station and transport system being disposed in a first housing;

said transport system including a transport direction changing element for changing a transporting direction of the medium between said first fixing station and said second fixing station;

said transport direction changing element contacting with the side of the medium whose surface has been fixed by said first fixing station to change the transporting direction of the medium to send out the medium to said second fixing station.

2. A double-sided printing apparatus as claimed in claim 1, wherein said first image forming process unit and said second image forming process unit are composed of common parts to each other.

3. A double-sided printing apparatus as claimed in claim 1, wherein said first fixing station and said second fixing station are composed of common components to each other.

4. A double-sided printing apparatus as claimed in claim 1, wherein said transport direction changing element includes a transport direction changing roller which contacts with one of the surfaces of the medium and rotates in the transporting direction of the medium, and the medium is wrapped over a predetermined angle around said transport direction changing roller.

5. A double-sided printing apparatus as claimed in claim 4, wherein said second fixing station performs flash fixing, and said transporting direction changing roller serves also as said light intercepting roller as a light intercepting member which intercepts light leaking from said second fixing station to prevent the leaking light from arriving at said second image forming process unit.

6. A double-sided printing apparatus as claimed in claim 1, wherein said transport system includes a turn-around element for changing the transporting direction of the medium between said second image forming process unit and said first fixing station.

7. A double-sided printing apparatus as claimed in claim 6, wherein said turn-around element includes a turn-around roller which contacts with the medium and rotates in the transporting direction of the medium, and the medium is wrapped over a predetermined angle around said turn-around roller.

8. A double-sided printing apparatus as claimed in claim 7, wherein said first fixing station performs flash fixing, and said turn-around roller serves also as a light intercepting roller as a light intercepting member which intercepts light leaking from said first fixing station to prevent the leaking light from arriving at said second image forming process unit.

9. A double-sided printing apparatus as claimed in claim 1, wherein an angle defined between a transport path of the medium in said first fixing station and a transport path of the medium in said second fixing station is equal to or greater than a predetermined angle.

10. A double-sided printing apparatus as claimed in claim 1, wherein an angle defined between a transport path of the medium in said second image forming process unit and the transport path of the medium in said second fixing station is equal to or greater than a predetermined angle.

11. A double-sided printing apparatus as claimed in claim 1, wherein said medium stacking section, a blower for collecting smoke generated from said first fixing station and said second fixing station and discharging the smoke to the outside, and a power supply section for operating said first fixing station and said second fixing station are disposed in a second housing, and said medium stacking section is disposed adjacent said first housing with respect to said blower and said power supply section.

12. A double-sided printing apparatus as claimed in claim 1, wherein the lengths of transport paths of the medium between said first image forming process unit and said medium stacking section and between said second image forming process unit and said medium stacking section are within a range within which data compensation is possible by a host apparatus which demands printing.

13. A double-sided printing apparatus as claimed in claim 1, wherein said transport system is disposed on the upstream side of said first image forming process unit and includes a plurality of tractor mechanisms common to each other for transporting the medium.

14. A double-sided printing apparatus as claimed in claim 13, wherein said plurality of tractor mechanisms are driven by a same driving source.

15. A double-sided printing apparatus as claimed in claim 14, wherein said plurality of tractor mechanisms and said driving source or sources are capable of transporting the medium in any one of a transporting direction for printing and a direction opposite to the transporting direction.

16. A double-sided printing apparatus as claimed in claim 15, wherein, when said plurality of tractor mechanisms transport the medium in the opposite direction, the medium is transported at a speed higher than a transporting speed for printing.

17. A double-sided printing apparatus as claimed in claim 13, wherein said plurality of tractor mechanisms are driven by driving sources which are independent of each other, and said driving sources drive said tractor mechanisms in synchronism with each other.

18. A double-sided printing apparatus as claimed in claim 17, wherein said plurality of tractor mechanisms and said driving source or sources are capable of transporting the medium in any one of a transporting direction for printing and a direction opposite to the transporting direction.

19. A double-sided printing apparatus as claimed in claim 18, wherein, when said plurality of tractor mechanisms transport the medium in the opposite direction, the medium is transported at a speed higher than a transporting speed for printing.

20. A double-sided printing apparatus as claimed in claim 13, further comprising a medium tensioning element provided on the upstream side of one of said plurality of tractor mechanisms which is disposed on the most downstream side for exerting a tension to act upon the medium in the direction opposite to the transporting direction for printing of the medium.

21. A double-sided printing apparatus as claimed in claim 20, wherein said medium tensioning element includes at least one pair of tensioning rollers disposed in an opposing relationship to each other with the medium interposed therebetween, and said double-sided printing apparatus further comprises a roller driving source for driving the driving side tensioning roller, which is one of said pair of tensioning rollers, to rotate while the driven side tensioning roller which is the other of said pair of tensioning rollers is driven by the medium being transported.

22. A double-sided printing apparatus as claimed in claim 21, wherein said roller driving source is capable of driving said driving side tensioning roller to rotate in any of the transporting direction for printing of the medium and the direction opposite to the transporting direction.

23. A double-sided printing apparatus as claimed in claim 22, wherein said roller driving source drives, when the medium is to be transported in the transporting direction for printing, said driving side tensioning roller to rotate such that a circumferential speed of said driving side tensioning roller is lower than the transporting speed for printing of the medium in the transporting direction for printing of the medium.

24. A double-sided printing apparatus as claimed in claim 23, wherein said roller driving source drives, when the medium is to be transported in the direction opposite to the transporting direction for printing, said driving side tensioning roller to rotate such that a circumferential speed of said driving side tensioning roller is higher than the transporting speed for printing of the medium in the direction opposite to the printing direction for printing of the medium.

25. A double-sided printing apparatus as claimed in claim 22, wherein said roller driving source drives, when the medium is to be transported in the direction opposite to the transporting direction for printing, said driving side tensioning roller to rotate such that a circumferential speed of said driving side tensioning roller is higher than the transporting speed for printing of the medium in the direction opposite to the printing direction for printing of the medium.

26. A double-sided printing apparatus as claimed in claim 21, wherein a one-way clutch is interposed between said roller driving source and said driving side tensioning roller.

27. A double-sided printing apparatus as claimed in claim 21, wherein said driven side tensioning roller is mounted for movement into and out of contact with the medium, and when the medium is to be transported in the transporting direction for printing, said driven side tensioning roller is brought into contact with the medium, but when the medium is to be transported in the direction opposite to the transporting direction for printing, said driven side tensioning roller is brought out of contact with the medium.

28. A double-sided printing apparatus as claimed in claim 1, wherein said first fixing station and said second fixing station perform flash fixing.

29. A double-sided printing apparatus as claimed in claim 28, wherein a light intercepting member for intercepting light leaking from at least one of said first fixing station and said second fixing station to prevent the leaking light from arriving at said first image forming process unit and said second image forming process unit is disposed at a medium non-passing location in the proximity of at least one of said first fixing station and said second fixing station.

30. A double-sided printing apparatus as claimed in claim 29, wherein said one light intercepting member or each of said light intercepting members is formed from a member having a low light transmittivity.

31. A double-sided printing apparatus as claimed in claim 29, wherein said one light intercepting member or each of said light intercepting members is formed from a member having a high light reflection factor at a portion thereof adjacent the corresponding fixing station.

32. A double-sided printing apparatus as claimed in claim 29, wherein said one light intercepting member or each of said light intercepting members includes a light intercepting roller which is capable of contacting with and being rotated by the medium as the medium is transported.

33. A double-sided printing apparatus as claimed in claim 29, further comprising:

a pair of shaft elements disposed at positions opposing each other with the medium interposed therebetween in a widthwise direction of the medium and extending in parallel to each other in a direction perpendicular to a plane in which the medium is transported;

a belt-like member extending in an endless fashion between and around said pair of shaft elements and serving as the light intercepting member;

said belt-like member having a narrower portion capable of allowing passage of the medium and a wider portion capable of intercepting light leaking from the fixing station;

said belt-like member being circulated around said pair of shaft elements so that light to pass the medium no-passing location is intercepted by said wider portion of said belt-like member in accordance with the width of the medium.

34. A double-sided printing apparatus as claimed in claim 33, wherein a surface of said belt-like member adjacent the fixing station is formed from a member having a high light reflection factor.

35. A double-sided printing apparatus as claimed in claim 33, wherein said belt-like member is formed from a member having a low light transmittivity.

36. A double-sided printing apparatus as claimed in claim 33, wherein said belt-like member is formed from a member having a low light reflection factor.

37. A double-sided printing apparatus as claimed in claim 29, further comprising a cooling mechanism for cooling said light intercepting member.

38. A double-sided printing apparatus as claimed in claim 1, wherein each of said first image forming process unit and said second image forming process unit includes a developing unit removably mounted thereon, and, when said developing unit is to be mounted or removed, the developing unit of said first image forming process unit and the developing unit of said second image forming process unit are movable in directions different from each other.

39. A double-sided printing apparatus as claimed in claim 38, wherein, when any of the developing units is to be mounted or removed, the developing unit moves in association with a paper jamming processing mechanism.

40. A double-sided printing apparatus as claimed in claim 1, wherein each of said first image forming process unit and said second image forming process unit includes a cleaner unit for collecting waste toner powder, and further includes:

a waste toner screw for discharging the waste toner powder collected by said cleaner unit;

a screw driving source for driving said waste toner screw to rotate; and a waste toner collector for collecting the waste toner powder discharged when said waste toner screw is driven to rotate by said screw driving source.

41. A double-sided printing apparatus as claimed in claim 40, wherein a toner cartridge after used is reused as said waste toner collector.

42. A double-sided printing apparatus as claimed in claim 28, wherein a light intercepting member having a length greater than a length of a photosensitive drum of said first image forming process unit or one of said first fixing station and said second fixing station, which is disposed adjacent the rear surface of the medium, in a widthwise direction of the medium for intercepting light leaking from the one fixing station to prevent the leaking light from arriving at said first image forming process unit is disposed between said first image forming process unit and the one fixing station, and another light intercepting member having a length greater than a length of a photosensitive drum of said second image forming process unit or the other one of said first fixing station and said second fixing station, which is disposed adjacent the front surface of the medium, in the widthwise direction of the medium for intercepting light leaking from the other fixing station to prevent the leaking light from arriving at said second image forming process unit is disposed between said second image forming process unit and the other fixing station.

43. A double-sided printing apparatus as claimed in claim 42, wherein each of said light intercepting members is formed from a member having a low light transmittivity.

44. A double-sided printing apparatus as claimed in claim 42, wherein each of said light intercepting members is formed from a member having a low light reflection factor.

45. A double-sided printing apparatus as claimed in claim 42, wherein each of said light intercepting members is formed from a member having a high light reflection factor at a portion thereof adjacent the corresponding fixing station.

46. A double-sided printing apparatus as claimed in claim 42, wherein each of said light intercepting members includes a light intercepting roller which is capable of contacting with and being rotated by the medium as the medium is transported.

47. A double-sided printing apparatus as claimed in claim 42, further comprising a cooling mechanism for cooling said light intercepting member.

48. A double-sided printing apparatus as claimed in claim 29, wherein said one light intercepting member or each of said light intercepting members is formed from a member having a low light reflection factor.

49. A double-sided printing apparatus for printing on a front surface and a rear surface of a medium according to claim 1, wherein single-sided printing is performed using;

either said first image forming process unit or said second image forming process unit for forming the toner image on one surface of the medium;

either said first fixing station or said second fixing station for fixing the toner image formed by either said first image forming process unit or said second image forming process unit; and said transport system.

50. A double-sided printing apparatus for printing on a front surface and a rear surface of a medium, comprising:

a first image forming process unit for forming a toner image on the first surface of the medium which is either one of the front surface or the rear surface of the medium;

a second image forming process unit disposed above said first image forming process unit for forming a toner image on the second surface of the medium that is another side of said first surface;

a first fixing station disposed above said second image forming process unit for fixing the toner image formed on one of said first surface or second surfaces of the medium;

a second fixing station disposed at a position different from that of said first fixing station for fixing the toner image formed on the other surface of the medium, which is not fixed by said first fixing station;

a medium stacking section for stacking the medium after printed;

said first image forming process unit, second image forming process unit, first fixing station and second fixing station being disposed in a first housing; and a transport direction changing element for changing a transporting direction of the medium on the downstream of said first image forming process unit and said second image forming process unit;

said transport direction changing element contacting with the side of the medium whose surface has been fixed by said first fixing station to change the transporting direction of the medium to said second fixing station.

* * * * *